US007994111B2

(12) United States Patent
Caggioni et al.

(10) Patent No.: US 7,994,111 B2
(45) Date of Patent: Aug. 9, 2011

(54) LIQUID DETERGENT COMPOSITION COMPRISING AN EXTERNAL STRUCTURING SYSTEM COMPRISING A BACTERIAL CELLULOSE NETWORK

(75) Inventors: Marco Caggioni, Cincinnati, OH (US); Rafael Ortiz, Milford, OH (US); Freddy Arthur Barnabas, West Chester, OH (US); Raul Victorino Nunes, Loveland, OH (US); Janine A. Flood, Cincinnati, OH (US); Francesc Corominas, Grimbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 232 days.

(21) Appl. No.: 12/370,714

(22) Filed: Feb. 13, 2009

(65) Prior Publication Data

US 2010/0210501 A1 Aug. 19, 2010

Related U.S. Application Data

(60) Provisional application No. 61/066,064, filed on Feb. 15, 2008.

(51) Int. Cl.

| | |
|---|---|
| ***C11D 3/22*** | (2006.01) |
| ***C11D 17/00*** | (2006.01) |
| ***C11D 1/02*** | (2006.01) |
| ***C11D 1/75*** | (2006.01) |

(52) U.S. Cl. ..... 510/473; 510/535; 424/484; 424/488; 424/70.13

(58) Field of Classification Search ..... 510/473, 510/535; 424/484, 488, 70.13

See application file for complete search history.

(56) References Cited

U.S. PATENT DOCUMENTS

| | | | | |
|---|---|---|---|---|
| 5,350,528 | A | 9/1994 | Westland et al. | |
| 5,362,713 | A | 11/1994 | Westland et al. | |
| 5,366,750 | A | 11/1994 | Morano et al. | |
| 5,998,349 | A | 12/1999 | Guillou | |
| 6,077,816 | A | 6/2000 | Puvvada et al. | |
| 6,241,812 | B1 * | 6/2001 | Smith et al. | 106/162.9 |
| 6,258,771 | B1 | 7/2001 | Hsu et al. | |
| 6,967,027 | B1 | 11/2005 | Heux et al. | |
| 2005/0203213 | A1 | 9/2005 | Pommiers et al. | |
| 2007/0027108 | A1 | 2/2007 | Yang et al. | |
| 2007/0197779 | A1 | 8/2007 | Yang et al. | |
| 2008/0108714 | A1 * | 5/2008 | Swazey et al. | 516/31 |

FOREIGN PATENT DOCUMENTS

| | | | |
|---|---|---|---|
| WO | WO-89/08148 | | 9/1989 |
| WO | WO-2006/116099 | A1 | 11/2006 |
| WO | WO-2007/068344 | A1 | 6/2007 |

OTHER PUBLICATIONS

PCT International Search Report mailed Jul. 15, 2009, 3 pages.

* cited by examiner

*Primary Examiner* — Brian P Mruk

(74) *Attorney, Agent, or Firm* — John T. Dipre; Leonard W. Lewis; Steven W. Miller

(57) ABSTRACT

A structured liquid detergent composition in the form of a liquid matrix made up of an external structuring system of a bacterial cellulose network; water; and surfactant system including an anionic surfactant; a nonionic surfactant; a cationic surfactant; an ampholytic surfactant; a zwitterionic surfactant; or mixtures thereof, wherein said liquid matrix has a yield stress of from about 0.003 Pa to about 5.0 Pa at about 25° C. and provides suitable particle suspension capabilities and shear thinning characteristics.

15 Claims, 6 Drawing Sheets

LIQUID DETERGENT COMPOSITION COMPRISING AN EXTERNAL STRUCTURING SYSTEM COMPRISING A BACTERIAL CELLULOSE NETWORK

CROSS-REFERENCE TO RELATED APPLICATIONS

This application claims priority under 35 U.S.C. §119(e) to U.S. Provisional Application Ser. No. 61/066,064 filed Feb. 15, 2008.

BACKGROUND OF THE INVENTION

Conventional approaches for providing distinctive structural and aesthetic properties to liquid compositions include: the addition of specific structuring agents including both internal and external structuring agents. Examples of known internal structuring agents include: surfactants, electrolytes (which can promote the formation of worm like micellar self assembly structures). Known external structuring agents include polymers or gums, many of which are known to swell or expand when hydrated to form random dispersion of independent microgel particles. Examples of polymers and gums include: gellan gum, pectine, alginate, arabinogalactan, caageenan, xanthum gum, guar gum, rhamsan gum, furcellaran gum, carboxymethylcellulose and cellulose. See e.g. U.S. Pat. No. 6,258,771 to Hsu et al. U.S. Pat. No. 6,077,816 to Puvvada et al. U.S. Patent Publ. No. 2005/0203213 to Pommiers et al.; and WO 2006/116099 to Fleckenstein et al. Although gums have been used to provide structuring benefits, the gums are pH dependant, i.e. failing at pH above 10. Further, certain gums have been found to be susceptible to degradation in the presence of detersive enzymes. Thus, there remains a need for other external structuring agents less susceptible to these and other known problems.

Another composition reported to provide structuring benefits is cellulose, i.e. bacterial celluloses. Conventional uses of bacterial celluloses include improving rheological properties for hydraulic fracturing fluids used for hydraulic fracturing of geological formations; addition to well bore drilling muds; and as a food ingredient. See e.g. U.S. Pat. Nos. 5,350,528, 5,362,713, and 5,366,750. The bacterial cellulose is typically cultured using a bacterial strain of *Acetobacter aceti* var. *xylinum* and dried using spray drying or freeze drying techniques. Attempts to manufacture and prepare the dried bacterial cellulose compositions which can be rehydrated and activated into a bacterial cellulose network for use in end products are known. Examples of these attempts are provided in U.S. Pat. No. 6,967,027 to Heux et al. and U.S. Patent Publ. No. 2007/0027108 to Yang et al. See also U.S. Publ. Nos. 2008/0108714 to Swazey et al. and 2007/197779 to Yang et al. and WO Publication No. 2007/068344 to Cai et al.

Two structuring properties which are desired in liquid detergent compositions include bead and/or particle suspension capabilities and shear thinning capabilities. Although it has been reported that the addition of certain external structuring agents into liquid detergent compositions may provide certain shear thinning benefits, the ability to provide shear thinning capabilities alone is insufficient to determine whether the liquid detergent composition is capable of suspending bead particles over time. As such, there remains a need for an external structuring agent which provides both shear thinning benefits and bead suspension capabilities. Further, these structuring benefits are desired at as low a level of external structurant as possible for cost and formulation concerns. For example, excessive amounts of external structuring agent may provide the particle suspension capability but result in the liquid composition becoming overly viscous and non-pourable. Further, too much external structuring agent may also result in compositional opacity and cloudiness which can be undesirable.

As such, there remains a need for an external structuring agent which provides both shear thinning capabilities and sufficient particle suspension capabilities while avoiding one or more of the above mentioned problems encountered with conventional formulations.

SUMMARY OF THE INVENTION

The present invention relates a liquid detergent composition comprising: a liquid matrix comprising: from about 0.005% to about 1.0% by weight of said liquid detergent composition of an external structuring system comprising a bacterial cellulose network; from about 30% to about 75% by weight of said liquid detergent composition of water; and from about 0.01% to about 70% by weight of said liquid detergent composition of a surfactant system comprising: an anionic surfactant; a nonionic surfactant; a cationic surfactant; an ampholytic surfactant; a zwitterionic surfactant; and mixtures thereof, wherein said liquid matrix has a yield stress of from about 0.003 Pa to about 5.0 Pa at about 25° C.

Another aspect of the present invention relates to a process of making a liquid detergent composition comprising: (a) providing a feed comprising from about 0.005% to about 1.0% by weight of a liquid detergent composition of an external structuring system comprising a bacterial cellulose with a solvent comprising water; activating said feed in a mixing chamber to energy density in excess of about $1.0\times10^5$ J/m$^3$, alternatively from about $2.0\times10^6$ J/m$^3$ to about $5.0\times10^7$ J/m$^3$, to form a bacterial cellulose network; and (b) providing a surfactant system at a level of from about 0.01% to about 70% by weight of said liquid detergent composition, said surfactant system comprising: an anionic surfactant; a nonionic surfactant; a cationic surfactant; an ampholytic surfactant; a zwitterionic surfactant; and mixtures thereof, wherein said step of providing a surfactant system is either performed along with step (a) or after step (b), wherein the step of providing said surfactant system with said bacterial cellulose network forms a liquid matrix having a yield stress of from about 0.003 Pa to about 5.0 Pa at about 25° C.

DETAILED DESCRIPTION OF THE INVENTION

Figure 1:
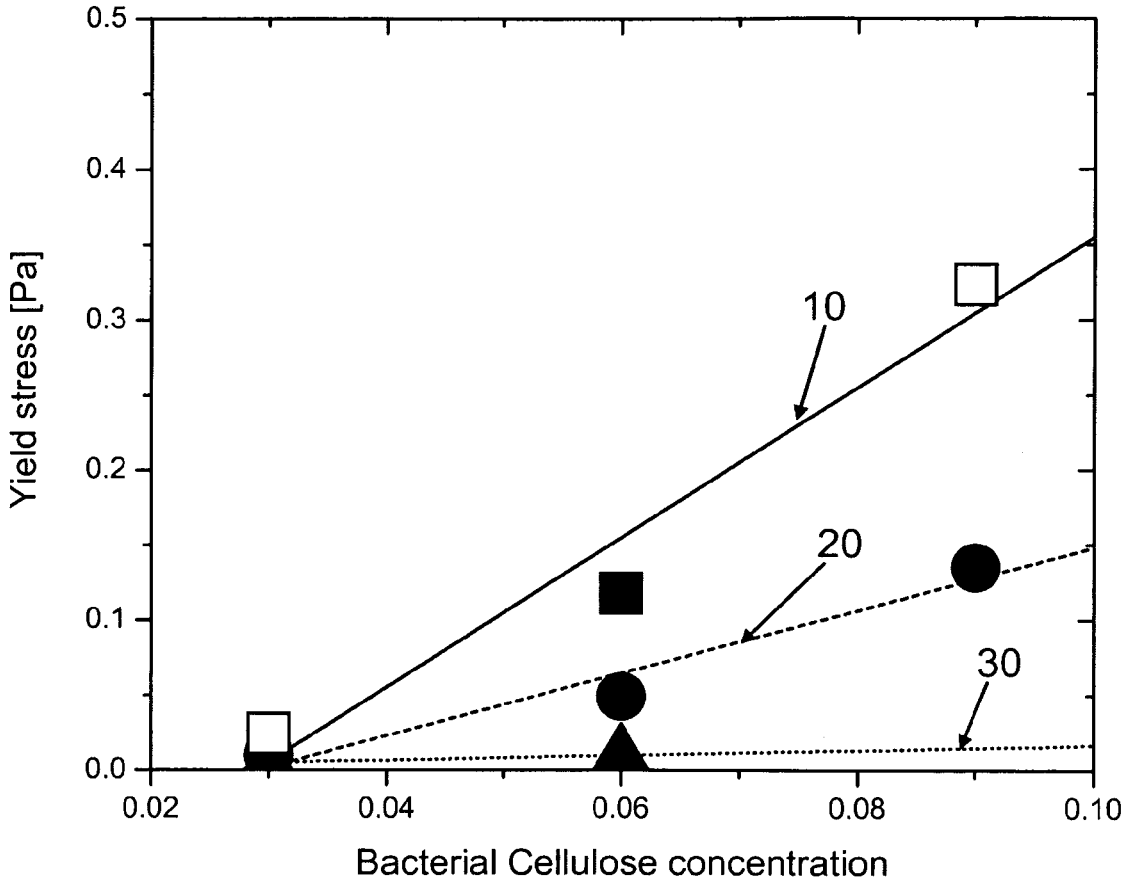
FIG. 1 shows a graphical representation of the relationship between bacterial cellulose concentrations to yield stress as a function of varying processing technologies.

It has notably been found that a liquid detergent composition a liquid matrix comprising: from about 0.005% to about 1.0% by weight of said liquid detergent composition of an external structuring system comprising a bacterial cellulose network; from about 30% to about 75% by weight of said liquid detergent composition of water; and from about 0.01% to about 70% by weight of said liquid detergent composition of a surfactant system comprising: an anionic surfactant; a nonionic surfactant; a cationic surfactant; an ampholytic surfactant; a zwitterionic surfactant; and mixtures thereof, wherein said liquid matrix has a yield stress of from about 0.003 Pa to about 5.0 Pa at about 25° C. provides sufficient particle suspending and shear thinning capabilities. In one embodiment, the bacterial cellulose network is formed by "activating" the bacterial cellulose and a solvent such as water under intense high shear processing conditions. Without intending to be bound by theory, it is believed that a liquid detergent composition comprising a bacterial cellulose network activated in this manner is capable of providing the desired structuring capabilities at relatively low levels while avoiding one or more of the problems encountered with conventional external structuring agents.

Definitions:

As used herein, "essentially free" of a component means that no amount of that component is deliberately incorporated into the composition.

As used herein, "intense high shear processing conditions" means a mixing step sufficient to activate the bacterial cellulose and provide the requisite yield stress of the present invention.

As used herein, "liquid matrix" refers to the liquid components of the present liquid detergent composition, where measurements made on the liquid matrix are performed in the absence of any suspension particles.

As used herein "suspension beads and/or particles" includes solid beads, capsules either empty or containing functional or non-functional ingredients therein, microcapsules, particles, and fragments thereof. "Plurality of suspension particles" includes both suspension beads and particles which can form from suspension beads which have broken apart.

As used herein, a "structurant" is any material which is added to the composition to provide Theological and structuring benefits, for example as measured by yield stress. As used herein, "external structurant" means a material which has as its primary function that of providing Theological alteration to the liquid matrix. Generally, therefore, an external structurant will not, in and of itself, provide any significant cleaning benefits or any significant ingredient solubilization benefits. An external structurant is thus distinct from an internal structurant which may also alter matrix rheology but which has been incorporated into the liquid composition for some additional or alternative primary purpose.

As used herein, all tests and measurements, unless otherwise specified, are made at 25° C.

1. Liquid Matrix Comprising an External Structuring System

The liquid detergent composition of the present invention comprises a liquid matrix comprising from about 0.005% to about 1.0% of an external structuring system, alternatively less than about 0.125%, alternatively less than about 0.05%, alternatively less than about 0.01% of said external structuring system, alternatively at least about 0.01%, alternatively at least about 0.05%, by weight of liquid detergent composition. The external structuring system for use in with the present invention comprises a bacterial cellulose network which is formed from individual bacterial cellulose fibers which are activated in the presence of water. In one embodiment, the external structuring system consists essentially of a bacterial cellulose network.

a. Bacterial Cellulose Network

The external structuring system of the present invention comprises a bacterial cellulose network at a level of up to about 100%, alternatively up to about 99%, alternatively up to about 95%, alternatively up to about 80%, alternatively up to about 70% by weight of said external structuring system. The term "bacterial cellulose" is intended to encompass any type of cellulose produced via fermentation of a bacteria of the genus *Acetobacter* and includes materials referred popularly as microfibrillated cellulose, reticulated bacterial cellulose, and the like.

The bacterial cellulose network is formed by processing of a mixture of the bacterial cellulose in a hydrophilic solvent, such as water, polyols (e.g., ethylene glycol, glycerin, polyethylene glycol, etc.), or mixtures thereof. This processing is called "activation" and comprises, generally, high pressure homogenization and/or high shear mixing. It has importantly been found that activating the bacterial cellulose under sufficiently intense processing conditions provides for increased yield stress at given levels of bacterial cellulose network. Yield stress, as defined below, is a measure of the force required to initiate flow in a gel-like system. It is believed that yield stress is indicative of the suspension ability of the liquid composition, as well as the ability to remain in situ after application to a vertical surface.

Activation is a process in which the 3-dimensional structure of the bacterial cellulose is modified such that the cellulose imparts functionality to the base solvent or solvent mixture in which the activation occurs, or to a composition to which the activated cellulose is added. Functionality includes providing such properties as shear-thickening, imparting yield stress—suspension properties, freeze-thaw and heat stability, and the like. The processing that is followed during the activation process does significantly more than to just disperse the cellulose in base solvent. Such intense processing "teases apart" the cellulose fibers to expand the cellulose fibers. The activation of the bacterial cellulose expands the cellulose portion to create a bacterial cellulose network, which is a reticulated network of highly intermeshed fibers with a very high surface area. The activated reticulated bacterial cellulose possesses an extremely high surface area that is thought to be at least 200-fold higher than conventional microcrystalline cellulose (i.e., cellulose provided by plant sources).

The bacterial cellulose utilized herein may be of any type associated with the fermentation product of *Acetobacter* genus microorganisms, and was previously available, one example, from CPKelco U.S. is CELLULON®. Such aerobic cultured products are characterized by a highly reticulated, branching interconnected network of fibers that are insoluble in water. The preparation of such bacterial cellulose products are well known and typically involve a method for producing reticulated bacterial cellulose aerobically, under agitated culture conditions, using a bacterial strain of *Acetobacter aceti* var. *xylinum*. Use of agitated culture conditions results in sustained production, over an average of 70 hours, of at least 0.1 g/liter per hour of the desired cellulose. Wet cake reticulated cellulose, containing approximately 80-85% water, can be produced using the methods and conditions disclosed in the above-mentioned patents. Dry reticulated bacterial cellulose can be produced using drying techniques, such as spray-drying or freeze-drying, that are well known. See U.S. Pat. Nos. 5,079,162 and 5,144,021.

*Acetobacter* is characteristically a gram-negative, rod shaped bacterium 0.6-0.8 microns by 1.0-4 microns. It is a strictly aerobic organism; that is, metabolism is respiratory, not fermentative. This bacterium is further distinguished by the ability to produce multiple poly β-1,4-glucan chains, chemically identical to cellulose. The microcellulose chains, or microfibers, of reticulated bacterial cellulose are synthesized at the bacterial surface, at sites external to the cell membrane. These microfibers have a cross sectional dimensions of about 1.6 nm to about 3.2 nm by about 5.8 nm to about 133 nm. In one embodiment, the bacterial cellulose network has a widest cross sectional microfiber width of from about 1.6 nm to about 200 nm, alternatively less than about 133 nm, alternatively less than about 100 nm, alternatively less than about 5.8 nm. Additionally, the bacterial cellulose network has an average microfiber length of at least 100 nm, alternatively from about 100 to about 1500 nm. In one embodiment, the bacterial cellulose network has a microfiber aspect ratio, meaning the average microfiber length divided by the widest cross sectional microfiber width, of from about 10:1 to about 1000:1, alternatively from about 100:1 to about 400: 1, alternatively from about 200:1 to about 300:1.

The presence of the bacterial cellulose network can be detected by a STEM micrograph imaging. A liquid detergent composition sample is obtained. A 1500 mesh copper TEM grid is placed on filter paper and 15 drops of the sample are applied to the TEM grid. The TEM grid is transferred to fresh filter paper and rinsed with 15 drops of deionized water. The TEM grid is then imaged in a S-5200 STEM micrograph instrument to observe for a fibrous network. Those of skill in the art will understand that if a fibrous network is detected, the cross dimensional of the fibers as well as the aspect ratio can be determined. Those of skill in the art will also recognized that alternative analytic techniques can be used to detect the presence of the bacterial cellulose network such as Atomic Force Microscopy using the same TEM grid and deposition and rinsing steps as disclosed above. An Atomic Force Microscopy 3D representation can be obtained showing the fiber dimensions as well as degree of networking.

The small cross sectional size of these *Acetobacter*-produced fibers, together with the large length and the inherent hydrophilicity of cellulose, provides a cellulose product having an unusually high capacity for absorbing aqueous solutions. Additives have often been used in combination with the bacterial cellulose to aid in the formation of stable, viscous dispersions.

Non-limiting examples of additional suitable bacterial celluloses are disclosed in and U.S. Pat. No. 6,967,027 to Heux et al.; U.S. Pat. No. 5,207,826 to Westland et al.; U.S. Pat. No. 4,487,634 to Turbak et al.; U.S. Pat. No. 4,373,702 to Turbak et al. and U.S. Pat. No. 4,863,565 to Johnson et al., U.S. Pat. Publ. No. 2007/0027108 to Yang et al.

i. Methods of Activating the Bacterial Cellulose

In one embodiment, the bacterial cellulose network is formed by activating the bacterial cellulose under intense high shear processing conditions. It has importantly been found that the use of intense high shear processing conditions provides the bacterial cellulose network with enhanced structuring capabilities. By using intense processing conditions, the bacterial cellulose network can provide the desired structuring benefits at lower levels and without a need for costly chemical and physical modifications.

In one embodiment, the step of activating said bacterial cellulose under intense high shear processing conditions comprises: activating the bacterial cellulose and a solvent, e.g. water, at an energy density above about $1.0\times10^6$ J/m$^3$, alternatively above than $2.0\times10^6$ J/m$^3$. In one embodiment, the step of activation is performed with an energy density from $2.0\times10^6$ J/m$^3$ to about $5.0\times10^7$ J/m$^3$, alternatively from about $5.0\times10^6$ J/m$^3$ to about $2.0\times10^7$ J/m$^3$, alternatively from about $8.0\times10^6$ J/m$^3$ to about $1.0\times10^7$ J/m$^3$. It has importantly been found that by activating the bacterial cellulose under the intense high shear processing conditions as set forth herein, that formulations having even below 0.05 wt % of said bacterial cellulose are capable of the desired rheological benefits such as yield stress and particle suspension. In one embodiment, where activation is performed via intense high shear processing, the level of bacterial cellulose is from 0.005 wt % to about 0.05 wt %, alternatively below about 0.03 wt %, alternatively below about 0.01 wt %.

Processing techniques capable of providing this amount of energy density include conventional high shear mixers, static mixers, prop and in-tank mixers, rotor-stator mixers, and Gaulin homogenizers, and SONOLATOR® from Sonic Corp of CT. In one embodiment, the step of activating the bacterial cellulose comprising is performed with a high pressure homogenizer comprising a mixing chamber and a vibrating blade, wherein the feed is forced into the mixing chamber through an orifice. The feed which is under pressure accelerates as it passes through the orifice and comes into contact with the vibrating blade.

In one embodiment, the step of activating said bacterial cellulose under intense high shear processing conditions involves causing hydrodynamic cavitation is achieved using a SONOLATOR®. Without intending to be bound by theory, it is believed that the mixture within the mixing chamber undergoes hydrodynamic cavitation within the mixing chamber causing the bacterial cellulose to form a bacterial cellulose network with sufficient degree of interconnectivity to provide enhanced shear thinning capabilities.

It has importantly been found that certain processing conditions enhance the ability of the bacterial cellulose to provide the desired rheological benefits to the composition, including enhanced yield stress at lower levels of the bacterial cellulose. Without intending to be bound by theory, this benefit is believed to be achieved by increasing the interconnectivity of the bacterial cellulose network formed within the liquid matrix.

One method to enhance the ability of the bacterial cellulose to form the bacterial cellulose network is to activate the bacterial cellulose with an aqueous solution as a premix under conventional mixing conditions prior to be placed in contact with a second stream. A second stream can be provided comprising the other desired components, such as the surfactants, perfumes, particles, adjunct ingredients, etc. In one embodiment, the bacterial cellulose and an aqueous solution are combined as a premix. This premix can be subjected to intense high shear conditions but need not be. In one embodiment, it is desired to perform this premix step using conventional mixing technologies such as a batch or continuous in line mixer at energy densities up to about $1.0\times10^6$ J/m$^3$.

Another method to enhance the ability of the bacterial cellulose to form the bacterial cellulose network is to contact the bacterial cellulose in dry or powder form directly into a feed stream of the liquid actives into the mixing chamber of an ultrasonic homogenizer or in line mixer. The powder can be added immediately before the feed(s) enter the mixing chamber or can be added as a separate feed from the active feed stream. Advantageously, by introducing the powder form without premixing or having a separate activation step, a single pass system can be achieved which allows for processing simplicity and cost/space savings.

ii. Polymeric Thickener Coated Bacterial Cellulose

In one embodiment, the external structuring system further comprises a bacterial cellulose which is at least partially coated with a polymeric thickener. This at least partially coated bacterial cellulose can be prepared in accordance with the methods disclosed in U.S. Pat. Publ. No. 2007/0027108 to Yang et al. at ¶¶ 8-19. In one suitable process, the bacterial cellulose is subjected to mixing with a polymeric thickener to at least partially coat the bacterial cellulose fibers and bundles. It is believed that the commingling of the bacterial cellulose and the polymeric thickener allows for the desired generation of a polymeric thickener coating on at least a portion of the bacterial cellulose fibers and/or bundles.

In one embodiment the method of producing said at least partially coated bacterial cellulose comprises a proportion of bacterial cellulose to polymeric thickener comprises from about 0.1% to about 5% of the bacterial cellulose, alternatively from about 0.5% to about 3.0%, by weight of the added polymeric thickener; and from about 10% to about 900% of the polymeric thickener by weight of the bacterial cellulose.

In one embodiment the polymeric thickener comprises a hydrocolloid, at least on charged cellulose ether, at least one polymeric gum, and mixtures thereof. One suitable hydrocolloid includes carboxymethylcellulose ("CMC"). Suitable polymeric gums comprises xanthan products, pectin, alginates, gellan gum, welan gum, diutan gum, rhamsan gum, kargeenan, guar gum, agar, gum Arabic, gum ghatti, karay gum, gum tragacanth, tamarind gum, locust bean gum, and the like and mixtures there.: See U.S. Pat. Publ. No. 2007/0027108 at ¶¶ 6 and 16.

In another embodiment, the bacterial cellulose undergoes no further modified either chemically or physically aside from the activation and/or the polymeric thickener coating. In one embodiment, the bacterial cellulose is free of a chemical modification comprising esterification or etherification by the addition of hydrophobic groups onto the fibers, meaning that the bacterial cellulose fibers are not modified to be surface active, wherein surface active means the ingredient lowers the surface tension of the medium in which it is dissolved. In another embodiment, the bacterial cellulose is free of any physical modification including coating the fibers with hydrophobic materials. It has importantly been found that by activating the bacterial cellulose network in accordance with the invention herein, the fibers do not need to be modified as mentioned in WO Publication No. 2007/068344 to Cai et al.

b. Additional Structuring Agents

In one embodiment, the external structuring system further comprises additional structuring agents such as non-polymeric crystalline hydroxyl-functional materials, polymeric structuring agents, and mixtures thereof.

i. Non-Polymeric Crystalline Hydroxyl-Functional Materials

One suitable additional structuring agent comprises a non-polymeric (except for conventional alkyoxlation), crystalline hydroxyl-functional materials, which forms thread-like structuring systems throughout the liquid matrix when they are crystallized within the matrix in situ. Such materials can be generally characterized as crystalline, hydroxyl-containing fatty acids, fatty esters or fatty waxes. See e.g. U.S. Pat. No. 7,169,741 at col. 9, line 61 to col. 11, line 4, and U.S. Pat. No. 6,080,708 and in WO Publ. No. 2002/0040627.

ii. Polymeric Structuring Agents

Other types of organic structuring agents, besides the non-polymeric, crystalline, hydroxyl-containing structuring agents described hereinbefore, may be utilized in the liquid detergent compositions herein. Polymeric materials which will provide shear-thinning capabilities to the liquid matrix may also be employed. Suitable polymeric structuring agents include those of the polyacrylate, polysaccharide or polysaccharide derivative type. Polysaccharide derivatives typically used as structuring agents comprise polymeric gum materials. Such gums include pectine, alginate, arabinogalactan (gum Arabic), carrageenan, gellan gum, xanthan gum and guar gum. Gellan gum is a heteropolysaccharide prepared by fermentation of Pseudomonaselodea ATCC 31461 and is commercially marketed by CP Kelco U.S., Inc. under the KELCOGEL tradename. Processes for preparing gellan gum are described in U.S. Pat. Nos. 4,326,052; 4,326,053; 4,377,636 and 4,385,123.

In one embodiment, the external structuring system is free of essentially free of any additional structuring agent known in the art such as those listed herein, for example: free or essentially free of non-polymeric crystalline hydroxyl-functional materials; free or essentially free of polymeric structuring agents including polymeric gums, pectine, alginate, arabinogalactan (gum Arabic), carrageenan, gellan gum, xanthan gum and guar gum. It has importantly been found that the external structuring system of the present invention provides sufficient rheological benefits, such as bead suspension and shear thinning capabilities, without reliance on structuring ingredients beyond the bacterial cellulose network described herein.

2. Structural Characteristics of the Liquid Matrix a. Yield Stress

The liquid matrix of the liquid detergent composition of the present invention has a yield stress of from about 0.003 Pa to about 5.0 Pa, alternatively from about 0.01 Pa to about 1.0 Pa, alternatively from about 0.05 Pa to about 0.2 Pa, as defined by the Yield Stress Test, defined herein. Importantly, although the % of bacterial cellulose is determined by total weight of the liquid detergent composition, including both liquid matrix and suspended particles, the yield stress is measured from only the liquid matrix. This is important because the presence of suspended particles can vary the yield stress measurements. It has importantly been found that higher energy density used during activation correlates to higher yield stress. In one embodiment, where the activation is by a SONOLATOR® at an energy density of from $2.0\times10^6$ J/m$^3$ to about $5.0\times10^7$ J/m$^3$, a liquid matrix having from about 0.006% to about 0.2% bacterial cellulose network provides a yield stress is from about 0.005 Pa to about 1 Pa, and from about 0.6% to about 1% bacterial cellulose network provides a yield stress from about 2.85 Pa to about 5 Pa.

Without intending to be bound by theory, it is believed that although known structuring agents are disclosed to provide shear thinning capabilities, the ability of a composition to suspend particles is not a direct correlation to the shear thinning capabilities of the composition. Rather, the ability of a composition to suspend particles is measured by the yield stress. For example, two compositions having the shear thinning capabilities within a given range of shear rate can have different yield stress values. It is believed that in order to stabilize the suspension particles in the liquid matrix of the liquid detergent composition, the stress applied by one single bead or particle should not exceed the yield stress of the liquid matrix. If this condition is fulfilled the liquid detergent composition will be less susceptible to, alternatively able to prevent, sedimentation or creaming and floating or settling of the suspension particles and/or particles under static conditions.

Yield Stress Tests:

For samples having less than 0.1% of bacterial cellulose, a dynamic yield stress test is conducted. The dynamic yield stress is conducted as follows: a sample is placed in an AR G2 Stress Controlled Rheometer equipped with double concentric cylinder geometry from TA Instruments ("Rheometer") and subjected to a range of shear from 100 $s^{-1}$ to 0.001 $s^{-1}$. Fifty measurement, spaced apart evenly in a logarithmic scale (as determined by the Rheometer) are performed at varying shear rates within the range stated, and the steady state viscosity and applied stress are measured and recorded for each imposed level of shear rate. The applied stress vs. imposed shear rate data are plotted on a chart and fitted to a modified Hershel-Bulkley model to account for the presence of a constant viscosity at high shear rate provided by the surfactant and adjunct ingredients present in the liquid matrix.

The following equation is used to model the stress of the liquid matrix:

$$\sigma = P1 + P2 * \dot{\gamma}^{P3} + P4 * \dot{\gamma}$$

where: σ: Stress, dependent variable; P1: Yield stress, fit parameter; P2: Viscosity term in Hershel-Bulkley model, fit parameter; $\dot{\gamma}$: Shear rate, independent variable; P3: Exponent in the Hershel-Bulkley model, fit parameter; and P4: Asymptotic viscosity at high shear rate, fit parameter. One of ordinary skill will understand that the fitting procedure due to the Hershel-Bulkley model to the data collected from the sample will output the P1 to P4 parameters, which include the yield stress (P1). The Herschel Bulkley model is described in "Rheometry of Pastes Suspensions and Granular Material" page 163, Philippe Coussot, John Wiley & Sons, Inc., Hoboken, N.J. (2005).

For samples having 0.1% or more of bacterial cellulose, a multiple creep test is conducted wherein the sample is placed in same Rheometer as used above and a range of stress is applied. First, a sample is loaded into the Rheometer equipped with double concentric cylinder geometry, a shear of 100 $s^{-1}$ is applied for 1 minute, then wait 1 minute. Next, measurements are conducted at varying amounts of applied stress and the Rheometer records the sample strain induced at each level of stress. The stress levels for this test are: 0.0001 Pa, 0.0005 Pa, 0.001 Pa, 0.0015 Pa, 0.002 Pa, 0.003 Pa, 0.004 Pa, 0.005 Pa, and so forth at 0.001 Pa intervals until a continuous displacement of the sample is recorded. The stress level resulting in this continuous displacement is considered the point where the stress applied is greater than the yield stress of the sample. If even the lowest amount of applied stress causes a continuous displacement, the yield stress of the material is below the resolution limit of the instrument.

Without intending to be bound by theory, it is believed that yield stress is indicative of the ability of the liquid detergent composition to suspend beads. Where the yield stress of the liquid detergent composition is equal or greater than the stress applied by a single beads suspended, the bead, once suspended in the liquid matrix, should remain suspended and neither tend to float or sink. The stress applied by a suspended bead is determined based on the net force applied by the single bead, F, divided by the surface over which this force is applied, S.

$$\sigma_B = \frac{F}{S}$$

F depends on the difference in density between the liquid matrix and the suspension particle as well as the suspension particle volume.

$$F = \frac{4}{3} \cdot \pi \cdot R^3 \cdot (\rho_s - \rho_l) \cdot g$$

$\rho_s$ and $\rho_1$ are the densities of the suspended bead and the liquid matrix, respectively, and R is the radius of the bead, and g is gravity.

S, is calculated by:

$$S = K \cdot (4 \cdot \pi \cdot R^2)$$

K has been calculated to be a constant of 3.5.

In addition to this basic condition that the stress applied by one single bead or particle should not exceed the yield stress of the liquid matrix under static condition, the behavior of the system becomes more complicated when external stress are applied to the liquid detergent composition. Under the action of external forces such as during product pouring, the liquid detergent composition is forced to flow, thus the yield stress during the pouring process is reduced and after the pouring the microstructure require some time to restore the its at rest properties. The pour use test described in the below section is used to evaluate the stability of the suspension particles during such external stress.

b. Pour Use Test

To confirm the ability of the liquid detergent composition to suspend beads under usage conditions, such as when poured or pressurized by pumping, a Pour Use Test can be conducted. In one embodiment the liquid detergent composition is capable of suspending beads and/or particles in accordance with the present invention under the Pour Use Test.

Pour Use Test: Testing is performed at 23° C. Step 1: fill 600 mL of the sample into a 600 mL clear plastic bottle such as the currently available Dawn PLUS with Power Scrubbers bottle or a bottle such as disclosed in U.S. D55,503. Step 2: At time 0, invert the bottle 135° and manually squeezing the bottle with one hand with a pressure of about 5 psi to about 10 psi upon the bottle allowing 9.4 grams of sample composition to be released from the bottle. Step 3: Place bottle back in upright standing position, at-rest position and take a picture of the front of the bottle and from the base of the bottle. Step 4: Wait 15 minutes, then repeat Steps 2 and 3, but turn the bottle 90° before manually squeezing the bottle. Repeat Step 4 until 450 mL of the sample has been released from the bottle. Compare the bead distribution in the pictures and if greater than ½ of the beads float to the top of the bottle or sink to the bottom of the bottle, the sample fails the test. Samples which fail the test are outside the scope of the present invention.

c. Shear Thinning Capabilities

The liquid matrix of the present invention is a shear thinning fluid, meaning that the liquid matrix has a specific pouring viscosity, a low stress viscosity, and a ratio of these two viscosity values. These viscosities are measured herein by using a Carrimed CLS 100 Viscometer with a 40 mm stainless steel parallel plate having a gap of 500 microns, at 25° C.

The pouring viscosity, as defined herein, is measured at a shear rate of 20 sec-1. Suitable external structuring agents are those which provide liquid matrix having a pouring viscosity which generally ranges from about 100 to about 2500 cps, alternatively from 100 to 1500 cps.

The low stress viscosity, as defined herein, is determined under a constant low stress of 0.1 Pa. The liquid matrix has a low stress viscosity of at least about 1,500 cps, alternatively at least about 10,000 cps, and alternatively at least 50,000 cps. This low stress viscosity represents the viscosity of the liquid matrix under typically usage stress conditions and during transportation and packaging. The low stress viscosity is measured using a Carrimed Viscometer in a low stress viscosity creep experiment over 5 minute intervals, again conducted at 25° C. Rheology measurements over the 5 minute interval are made after the rheology of the matrix has recovered completely from any past high-shear events and has rested at zero shear rate for 10 minutes between loading the sample in the viscometer and running the test. The data over the last 3 minutes are used to fit a straight line, and from the slope of this line viscosity is calculated.

Finally, to exhibit suitable shear-thinning characteristics, in one embodiment, the liquid matrix has a ratio of its low stress viscosity to its pouring viscosity value, which is at least about 2, alternatively at least about 10, alternatively at least about 100, up to about 2000 or about 1000.

d. Freeze-Thaw Stability

In another embodiment, the liquid detergent composition provides freeze-thaw stability. Freeze-thaw stability means that the composition generally retains the same yield stress and shear thinning index after 1 to 3 freeze-thaw cycles. As used herein, "generally retains" means that the yield stress, shear thinning remains within about 1% to about 5% from prior to the cycle, after each successive freeze-thaw cycle(s). Additionally, the pour use test is measured as continuing to pass after successive freeze-thaw cycle(s). One of skill in the art will understand how to perform a freeze-thaw test: briefly, a sample is prepared and stored in a 600 mL clear plastic bottle. The sample is then flash frozen, then allowed to what at room temperature, resulting in one freeze-thaw cycle. The yield stress, shear-thinning characteristics and pour use test can be calculated.

3. Surfactant System

The liquid matrix of the liquid detergent composition can be made for any suitable cleaning purpose, including but not limited to: laundry cleaning; hard surface cleaning, such as hand dish cleaning, counter top or table cleaning, window cleaning, and automatic dish washing; and as a personal care product for hair (shampoo or conditioner) or body wash. As such, the surfactant system is selected based on the desired application. Suitable surfactants include any conventional surfactants known for use with the above cleaning purposes.

Although surfactants can provide some structuring and rheology modifying benefits. The surfactant system of the present invention is not included in the definition of external structurant.

The liquid matrix comprises from about 0.01% to 70%, alternatively from about 1% to about 50%, alternatively from about 3% to about 20% of a surfactant system, by weight of the liquid detergent composition. The surfactant system of the present invention comprising: an anionic surfactant; a nonionic surfactant; a cationic surfactant; an ampholytic surfactant; a zwitterionic surfactant; and mixtures thereof. Suitable surfactants for use herein are disclosed in U.S. 2005/0203213 to Pommiers et al., 2004/0018950 to Foley et al., WO 2006/116099 to Fleckenstein et al., and U.S. Pat. No. 7,169,741 to Barry et al.

In one embodiment, the liquid matrix comprises a weight ratio of surfactant system to external structurant, i.e. bacterial cellulose network, of from about 1:1 to about 5000:1, alternatively from about 100:1 to about 2000:1, alternatively from about 500:1 to about 1000:1. Importantly, although the amounts of both external structurant and surfactants can vary, the present invention is capable of providing suitable shear thinning capabilities and yield stress with higher amounts of external structurant to surfactant system, such as greater than 1000:1.

a. Anionic Surfactants

In one embodiment, the liquid matrix comprises from about 5% to about 60%, alternatively from about 10% to about 40%, alternatively from about 15% to about 35% by weight of liquid detergent composition, of one or more of the below anionic surfactants. Suitable anionic surfactants include the alkyl sulfonic acids, alkyl benzene sulfonic acids, ethoxylated alkyl sulfates and their salts as well as alkoxylated or un-alkoxylated alkyl sulfate materials.

In one embodiment, the anionic surfactant comprises an alkali metal salts of $C_{10-16}$ alkyl benzene sulfonic acids, preferably $C_{11-14}$ alkyl benzene sulfonic acids. In one embodiment, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Other suitable anionic surfactants include: sodium and potassium linear straight chain alkylbenzene sulfonates in which the average number of carbon atoms in the alkyl group is from about 11 to about 14. Sodium $C_{11}$-$C_{14}$ e.g., $C_{12}$, LAS is one suitable anionic surfactant for use herein.

Another suitable anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$-$C_{20}$ alkyl group, n is from about 1 to about 20, and M is a salt-forming cation; alternatively, R' is $C_{10}$-$C_{18}$ alkyl, n is from about 1 to about 15, and M is sodium, potassium, ammonium, alkylammonium, or alkanolammonium. In another embodiment, R' is a $C_{12}$-$C_{16}$, n is from about 1 to about 6 and M is sodium. The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Suitable unalkoyxylated, e.g., unethoxylated, alkyl ether sulfate surfactants are those produced by the sulfation of higher $C_8$-$C_{20}$ fatty alcohols. Conventional primary alkyl sulfate surfactants have the general formula of: $ROSO_3—M^+$, wherein R is typically a linear $C_8$-$C_{20}$ hydrocarbyl group, which may be straight chain or branched chain, and M is a water-solubilizing cation; alternatively R is a $C_{10}$-$C_{15}$ alkyl, and M is alkali metal. In one embodiment, R is $C_{12}$-$C_{14}$ and M is sodium.

One embodiment provides a surfactant system comprises from about 10% to 35% by weight of said liquid detergent composition of an anionic surfactant comprising: C10-16 linear alkylbenzene sulfonates, C8-20 alkyl polyethoxylate sulfates having from about 1 to 20 moles of ethylene oxide, C8-16 alcohol polyethoxylates having from about 1 to 16 moles of ethylene oxide, and mixtures thereof.

Where the liquid detergent composition is for personal care (i.e. shampoo or body wash), the anionic surfactant can include: ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, triethanolamine lauryl sulfate, triethanolamine lauryl sulfate, monoethanolamine cocoyl sulfate, monoethanolamine lauryl sulfate, sodium tridecyl benzene sulfonate, sodium dodecyl benzene sulfonate, and mixtures thereof. Non limiting examples of other anionic, zwitterionic, amphoteric or optional additional surfactants, and other adjunct ingredients suitable for use in the personal care compositions are described in McCutcheon's, Emulsifiers and Detergents, 1989 Annual, published by M. C. Publishing Co., and U.S. Pat. Nos. 3,929,678; 2,658,072; 2,438,091; and 2,528,378.

b. Nonionic Surfactants

In one embodiment, the liquid matrix comprises from about 0.1% to about 20%, alternatively from about 0.2% to about 15%, alternatively from about 0.5% to about 10%, by weight of the liquid detergent composition, of a nonionic surfactant(s). Suitable nonionic surfactants include any of the conventional nonionic surfactant types typically used in liquid cleaning compositions. These include alkoxylated fatty alcohols, ethylene oxide (EO)-propylene oxide (PO) block polymers, and amine oxide surfactants. Suitable for use in the liquid cleaning compositions herein are those nonionic surfactants which are normally liquid.

Suitable nonionic surfactants for use herein include the alcohol alkoxylate nonionic surfactants. Alcohol alkoxylates are materials which correspond to the general formula of: $R^1(C_mH_{2m}O)_nOH$, wherein $R^1$ is a $C_8$-$C_{16}$ alkyl group, m is from 2 to 4, and n ranges from about 2 to about 12; alternatively $R^1$ is an alkyl group, which may be primary or secondary, that contains from about 9 to about 15 carbon atoms, alternatively from about 10 to about 14 carbon atoms. In another embodiment, the alkoxylated fatty alcohols will be ethoxylated materials that contain from about 2 to about 12, alternatively about 3 to about 10, EO moieties per molecule.

The alkoxylated fatty alcohol materials useful in the liquid compositions herein will frequently have a hydrophilic-lipophilic balance (HLB) which ranges from about 3 to about 17, alternatively from about 6 to about 15, alternatively from about 8 to about 15. Alkoxylated fatty alcohol nonionic surfactants have been marketed under the tradenames Neodol and Dobanol by the Shell Chemical Company.

Another nonionic surfactant suitable for use includes ethylene oxide (EO)—propylene oxide (PO) block polymers, such as those marketed under the tradename Pluronic. These materials are formed by adding blocks of ethylene oxide moieties to the ends of polypropylene glycol chains to adjust the surface active properties of the resulting block polymers. See Davidsohn and Milwidsky; *Synthetic Detergents,* 7th Ed.; Longman Scientific and Technical (1987) at pp. 34-36, 189-191 and in U.S. Pat. Nos. 2,674,619 and 2,677,700.

Yet another suitable type of nonionic surfactant useful herein comprises the amine oxide surfactants. In one embodiment of the present invention, liquid detergent compositions comprises from about 0.1% to about 20%, alternatively from about 1% to about 15%, alternatively from about 3.0% to about 10% by weight of the liquid detergent composition of an amine oxide surfactant. Amine oxides are often referred to in the art as "semi-polar" nonionics, and have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from about 8 to about 20, alternatively from about 10 to about 16 carbon atoms, and alternatively a $C_{12}$-$C_{16}$ primary alkyl. R' is a short-chain moiety such as a hydrogen, methyl and —$CH_2OH$. When x+y+z is different from 0, EO is ethyleneoxy, PO is propyleneneoxy and BO is butyleneoxy, i.e. $C_{12-14}$ alkyldimethyl amine oxide.

In one embodiment, the surfactant system comprises anionic and nonionic surfactant at a weight ratio of from about 100:1 to about 1:100, alternatively from about 20:1 to about 1:20, alternatively from about 2.5:1 to about 18:1.

c. Cationic Surfactants

Cationic surfactants, when present in the detersive form of the composition, is present in an effective amount, such as from 0.1% to 20%, alternatively from about 0.2% to about 5%, alternatively from about 0.5% to about 1%, by weight of the liquid detergent composition.

Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of an quaternary ammonium alcohol, such as quaternary chlorine esters. More preferably, the cationic surfactants have the following formula:

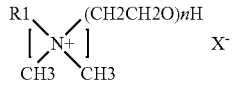

wherein R1 is $C_8$-$C_{18}$ hydrocarbyl and mixtures thereof, alternatively $C_{8-14}$ alkyl, alternatively $C_8$, $C_{10}$ or $C_{12}$ alkyl, and X is an anion such as chloride or bromide.

d. Additional Surfactants

Other suitable surfactants include ampholytic surfactants, zwitterionic surfactants, and mixtures thereof. Suitable ampholytic surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. When present, ampholytic surfactants comprise from about 0.01% to about 20%, alternatively from about 0.5% to about 10% by weight of the liquid detergent composition.

4. Diamines

Another optional ingredient of the liquid detergent compositions according to the present invention is a diamine. Where the liquid detergent composition is a detersive composition, the liquid surfactant system can contain from about 0% to about 15%, alternatively from about 0.1% to about 15%, alternatively from about 0.2% to about 10%, alternatively from about 0.25% to about 6%, alternatively from about 0.5% to about 1.5% by weight of said liquid detergent composition of at least one diamine.

Suitable organic diamines are those in which pK1 and pK2 are in the range of about 8.0 to about 11.5, alternatively in the range of about 8.4 to about 11, alternatively from about 8.6 to about 10.75. Suitable materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®)

(pK1=11.2; pK2=10.0). Other suitable materials diamines include primary/primary diamines with alkylene spacers ranging from $C_4$ to $C_8$.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by DUPONT®, a supplier of diamines. As a working definition herein, the pKa of the diamines is specified in an all-aqueous solution at 25° C. and for an ionic strength from 0.1 to 0.5 M.

In one embodiment of the present invention, said surfactant system is free or essentially free of any of said above surfactants, for example: free or essentially free of non-ionic surfactant, free or essentially free of cationic surfactant.

5. Suspension Particles

In one embodiment, the liquid detergent compositions further comprises a plurality of suspension particles at a level of from about 0.01% to about 5% by weight, alternatively from about 0.05% to about 4% by weight, alternatively from about 0.1% to about 3% by weight. Examples of suitable suspension particles are provided in U.S. Pat. No. 7,169,741 to Barry et al. at col. 12-18 and U.S. Patent Publ. No. 2005/0203213 to Pommiers et al., ¶¶ 14-60.

a. Liquid Core Suspension Particles

In one embodiment, one or more of the suspension particles have liquid cores. These particles function especially well in terms of stability within the detergent composition prior to use, yet are suitably unstable in the washing liquors formed from such products. In one embodiment the liquid core has an ionically charged polymeric material encapsulated by a semipermeable membrane. This membrane is one which can be formed by interaction of some of the ionically charged polymer in the core with another polymeric material of opposite charge. Nonlimiting examples of suitable liquid core suspension particles are available in U.S. Pat. No. 7,169,741.

b. Solid Core Suspension Particles

Another type of suspension particle which is suitable for use herein includes particles (or beads) with solid cores. In one embodiment, the plurality of suspension particles comprises a friable bead such as disclosed in EP 670 712. One suitable use for such a friable bead is for exfoliation of the skin. Suitable beads or particles for exfoliating can have a particle size in the range of 0.03 to 3 mm. Further, these beads can be friable meaning that during use they break up into particles having an average size of less than 50 microns. In one embodiment, the suspension particle comprises a pearlescence modifier. Suitable pearlescence modifiers include ethylene glycol distearate (EGDS), $TiO_2$, ZnO, Mica and mixtures thereof.

c. Particle Size/Shape

In one embodiment, the suspension particles are visibly distinct beads suspended within the liquid detergent composition. In another embodiment, the suspension particles are not visibly distinct in the liquid detergent composition. Particle or bead visibility is, of course, determined by a number of interrelated factors including size of the beads and the various optical properties of the beads and of the liquid composition they are dispersed within. A transparent or translucent liquid matrix in combination with opaque or translucent beads will generally render the particles visible if they have a minor dimension of 0.2 mm or greater, but smaller beads may also be visible under certain circumstances. Even transparent beads in a transparent liquid matrix might be visibly distinct if the refractive properties of the particles and liquid are sufficiently different. Furthermore, even particles dispersed in a somewhat opaque liquid matrix might be visibly distinct if they are big enough and are different in color from the matrix. As used herein, visibly distinct refers to particles having a minor dimension of 0.2 mm or greater, whereas not visibly distinct refers to particles having a minor dimension of less than 0.2 mm.

In one embodiment, the suspension particles have a particle size in the range from about 100 nanometers to about 8 mm. As defined herein, "particle size" means that at least one of said suspension particles have a longest linear dimension as defined. Those of skill in the art will understand that suitable techniques to measure particle size are available, for example, suspension particles having a particle size from about 10 nanometers to 5000 nanometers is by light scattering technique such as with a Brookhaven 90Plus Nanoparticle Size Analyzer, wherein a sample of the composition is diluted to a concentration ranging from 0.001% to 1% v/v using a suitable wetting and/or dispersing agents. A 10 mL sample of the diluted sample is placed into a sample cell and measurements are recorded providing average particle diameter; optical microscopy can be used to detect particle sizes between 5 microns to about 500 microns; and macroscopic measuring techniques can measure from 0.5 mm to 8 mm.

It has importantly been found that the liquid detergent composition of the present invention is capable of suspending a vast range of particles, from visibly distinct particles with particle size up to about 8 mm to pearlescence agents which have particle sizes typically below 500 μm. In one embodiment, the particle size is from about 0.1 mm to about 8 mm, alternatively from about 0.3 mm to about 3 mm, and alternatively from about 0.5 to about 4 mm. In another embodiment, the suspension particles are not visibly distinct, comprising a particle size of from about 1 nanometers to about 500 μm, alternatively from about 1 μm to about 300 μm, alternatively from about 50 μm to about 200 μm.

In another embodiment the liquid detergent composition comprises from about 0.1% to about 2% of said suspension particles in the range of about 50 to about 750 microns of particle size, such as a Silica-$TiO_2$ particles which function as sensory and skin exfoliating signals and a grease removal enhancing agent on dishes. Additionally, polyethylene beads and butylene/ethylene copolymers of a particle size ranging from about 50 to about 350 microns can be used. See WO 2005/010138 to Paye et al.

d. Particle Density

The suspension particles useful herein will have a density of from about 700 kg/m$^3$ to about 4,260 kg/m$^3$, alternatively from about 800 kg/m$^3$ to about 1,200 kg/m$^3$, alternatively from about 900 kg/m$^3$ to about 1,100 Kg/m$^3$, alternatively from about 940 kg/m$^3$ to about 1,050 kg/m$^3$, alternatively from about and 970 kg/m$^3$ to about 1,047 kg/m$^3$, alternatively from about and 990 kg/m$^3$ to about 1,040 kg/m$^3$.at about 25° C.

The liquid detergent composition of the present invention is capable of suspending particles for 4 weeks at 25° C. Stability can be evaluated by the Pour Use test, by direct observation or by image analysis, by having colored particles suspended in a transparent liquid contained in a transparent bottle. A freshly made composition of the present invention is considered to be stable if less than 10%, preferably less than 5% and more preferably less than 1% by weight of the particles settle to the bottom of the container after 4 weeks static storage.

In one embodiment, the difference between the density of the liquid matrix and the density of the particles is less than about 10% of the liquid matrix density, alternatively less than about 5% and alternatively less than about 3%, alternatively less than about 1%, alternatively less than about 0.5%, at about 25° C. In another embodiment, the liquid matrix and the suspension particle have a density difference of from about 1 $kg/m^3$ to about 3,260 $kg/m^3$, alternatively from about 10 $kg/m^3$ to about 200 $kg/m^3$, alternatively from about 50 $kg/m^3$ to about 100 $kg/m^3$.

Suitably the particles are suspended so that the liquid detergent compositions are stable for 4 weeks at 25° C. Stability can be evaluated by direct observation or by image analysis, by having colored particles suspended in a transparent liquid contained in a transparent bottle. A detergent composition freshly made is considered to be stable if less than about 10%, alternatively less than about 5%, alternatively less than about 1% by weight of the particles settle to the bottom of the bottle after 4 weeks static storage.

Additional suitable particles and/or particles for use herein are disclosed in U.S. Patent Publ. No. 2005/0203213 to Pommiers et al., and WO 2005/010138 to Paye et al. at page 9-10.

e. Particle Burst Strength

Particles suitable for use in the liquid detergents herein should be physically and chemically compatible with the detergent matrix ingredients, but they can disintegrate in use without leaving residues on fabrics, hair or body parts, such as hands, and/or hard surfaces such as dishes or being treated. Thus within the liquid matrix of the detergent compositions, the particles are capable of withstanding a force before bursting or breaking of from about 20 mN to about 20,000 mN, alternatively from about 50 mN to about 15,000 mN, alternatively from about 100 mN to about 10,000 mN. This strength makes them suitable for industrial handling, including liquid detergent making processes. They can also withstand pumping and mixing operations without significant breakage and are also stable on transport. At the same time, the particles herein disintegrate readily in use by virtue of their osmotic behavior in dilute aqueous media such as agitated washing liquors.

f. Perfume Microcapsules

In one embodiment, the liquid detergent composition comprises a perfume. Perfume is typical incorporated in the present compositions at a level of at least about 0.001%, preferably at least about 0.01%, more preferably at least about 0.1%, and no greater than about 10%, preferably no greater than about 5%, more preferably no greater than about 3%, by weight.

In one embodiment, the perfume of the fabric conditioning composition of the present invention comprises an enduring perfume ingredient(s) that have a boiling point of about 250° C. or higher and a ClogP of about 3.0 or higher, more preferably at a level of at least about 25%, by weight of the perfume. Suitable perfumes, perfume ingredients, and perfume carriers are described in U.S. Pat. No. 5,500,138; and US 20020035053 A1.

In another embodiment, the perfume comprises a perfume microcapsule and/or a perfume nanocapsule. Suitable perfume microcapsules and perfume nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. Nos. 6,645,479; 6,200,949; 4,882,220; 4,917,920; 4,514,461; U.S. RE 32,713; U.S. Pat. No. 4,234,627.

In yet another embodiment, the liquid detergent composition comprises odor control agents such as described in U.S. Pat. No. 5,942,217: "Uncomplexed cyclodextrin compositions for odor control", granted Aug. 24, 1999. Other agents suitable odor control agents include those described in: U.S. Pat. Nos. 5,968,404, 5,955,093; 6,106,738; 5,942,217; and U.S. Pat. No. 6,033,679.

6. Water

The liquid detergent compositions of the present invention will contain the suitable amounts of water in order to form the structured liquid matrix thereof. In one embodiment, water comprises from about 30% to about 75%, alternatively from about 35% to about 72%, alternatively from about 40% to about 70%, alternatively greater than about 50% by weight of the liquid detergent compositions herein.

In one embodiment the liquid detergent composition is a concentrated formulation comprising as low as about 1% to about 30% water, alternatively from about 5% to about 15%, alternatively from about 10% to about 14%. Concentrated formulations would be particularly desirable for embodiments where the present composition is encapsulated in a unit dose article.

7. Adjunct Ingredients a. Organic Solvents

The present compositions may optionally comprise an organic solvent. Suitable organic solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. In one embodiment, the liquid detergent composition comprises from about 0.0% to less than 50% of a solvent. When present, the liquid detergent composition will contain from about 0.01% to about 20%, alternatively from about 0.5% to about 15%, alternatively from about 1% to about 10% by weight of the liquid detergent composition of said organic solvent. These organic solvents may be used in conjunction with water, or they may be used without water.

b. Polycarboxylate

The present composition may comprise a polycarboxylate polymer, a co-polymer comprising one or more carboxylic acid monomers. A water soluble carboxylic acid polymer can be prepared by polyimerizing a carboxylic acid monomer or copolymerizing two monomers, such as an unsaturated hydrophilic monomer and a hydrophilic oxyalkylated monomer. Examples of unsaturated hydrophilic monomers include acrylic acid, maleic acid, maleic anhydride, methacrylic acid, methacrylate esters and substituted methacrylate esters, vinyl acetate, vinyl alcohol, methylvinyl ether, crotonic acid, itaconic acid, vinyl acetic acid, and vinylsulphonate. The hydrophilic monomer may further be copolymerized with oxyalkylated monomers such as ethylene or propylene oxide. Preparation of oxyalkylated monomers is disclosed in U.S. Pat. No. 5,162,475 and U.S. Pat. No. 4,622,378. The hydrophilic oxyalkyated monomer preferably has a solubility of about 500 grams/liter, more preferably about 700 grams/liter in water. The unsaturated hydrophilic monomer may further be grafted with hydrophobic materials such as poly(alkene glycol) blocks. See, for example, materials discussed in U.S. Pat. Nos. 5,536,440, 5,147,576, 5,073,285, 5,534,183, 5,574,004, and WO 03/054044.

c. Magnesium Ions

The optional presence of magnesium ions may be utilized in the detergent composition when the liquid detergent compositions are used in softened water that contains few divalent ions. When utilized, the magnesium ions are added as a hydroxide, chloride, acetate, sulfate, formate, oxide or nitrate salt to the liquid detergent compositions of the present invention. When included, the magnesium ions are present at an active level of from about 0.01% to about 1.5%, alternatively from about 0.015% to about 1%, alternatively from about 0.025% to about 0.5%, by weight of the liquid detergent composition.

d. Hydrotrope

The liquid detergent compositions optionally comprises a hydrotrope in an effective amount, i.e. from about 0% to 15%, or about 1% to 10%, or about 3% o about 6%, so that the liquid detergent compositions are compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

e. Polymeric Suds Stabilizer

The liquid detergent compositions of the present invention may optionally contain a polymeric suds stabilizer at a level from about 0.01% to about 15%. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from about 1,000 to about 2,000,000, alternatively from about 5,000 to about 1,000,000, alternatively from about 10,000 to about750,000, alternatively from about 20,000 to about 500,000, alternatively from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One suitable polymeric suds stabilizer is (N,N-dimethylamino)alkyl acrylate esters, namely the acrylate ester represented by the following formula:

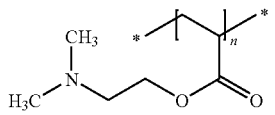

When present in the liquid detergent compositions, the polymeric suds booster may be present in the liquid detergent composition from about 0.01% to about 15%, alternatively from about 0.05% to about 10%, alternatively from about 0.1% to about 5%, by weight of the liquid detergent composition.

f. Carboxylic Acid

The liquid detergent compositions according to the present invention may comprise a linear or cyclic carboxylic acid or salt thereof to improve the rinse feel of the liquid detergent composition. The presence of anionic surfactants, especially when present in higher amounts in the region of 15-35% by weight of the liquid detergent composition, results in the liquid detergent composition imparting a slippery feel to the hands. This feeling of slipperiness is reduced when using the carboxylic acids as defined herein i.e. the rinse feel becomes draggy.

Carboxylic acids useful herein include salicylic acid, maleic acid, acetyl salicylic acid, 3 methyl salicylic acid, 4 hydroxy isophthalic acid, dihydroxyfumaric acid, 1, 2, 4 benzene tricarboxylic acid, pentanoic acid and salts thereof and mixtures thereof. Where the carboxylic acid exists in the salt form, the cation of the salt is selected from alkali metal, alkaline earth metal, monoethanolamine, diethanolamine or triethanolamine and mixtures thereof.

In one embodiment, the carboxylic acid or salt thereof, when present, is present at the level of from about 0.1% to about 5%, alternatively from about 0.2% to about 1%, alternatively from about 0.25% to about 0.5%.

g. Compositional pH

In one embodiment, the liquid detergent composition has a pH of from about 4 to about 14, alternatively from about 6 to about 13, alternatively from about 6 to about 10, alternatively an basic pH of greater than about 7. It has importantly been found that the bacterial cellulose network is capable of providing the desired structuring benefits at pH above about 7, or about 10.

h. Additional Adjuncts Components

The liquid detergent compositions herein can further comprise a number of adjunct components. In one such embodiment, the liquid detergent compositions comprises from about 0.1% to about 30%, alternatively from about 0.5% to about 20%, alternatively from about 1% to about 10%, of one or more of said additional adjunct components.

The additional adjunct component may comprise one or more detersive enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, mannanases, pentosanases, malanases, β-glucanases, arabinosidases, hyaluronidase, chondroitinase, laccase, and known amylases, or combinations thereof. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839.

If employed, enzymes will normally be incorporated into the liquid laundry detergent compositions herein at levels sufficient to provide up to 10 mg by weight, more typically from about 0.01 mg to about 5 mg, of active enzyme per gram of the composition. Stated otherwise, the aqueous liquid detergent compositions herein can typically comprise from about 0.001% to about 5%, alternatively from about 0.01% to about 1% by weight, of a commercial enzyme preparation. Protease enzymes, for example, are usually present in such commercial preparations at levels sufficient to provide from 0.005 to 0.1 Anson units (AU) of activity per gram of detergent composition. Importantly, the present external structuring agent is believed to provide sufficient structuring capabilities, including bead suspension and shear thinning capabilities, in the presence of detersive enzymes for extended periods of time, such as for 6 months or more.

Additional adjunct components are optical brighteners at levels of from 0.01% to about 1%, dye transfer inhibition agents at levels of from about 0.0001% to about 10%, suds suppressors at levels of from about 0.001% to about 2%, soil release polymers at levels of from about 0.01% to about 10%, silicone polymers from about 0.01% to about 50%, perfume, dyes, opacifiers, chelants, thickening agents and pH buffering agent. A further discussion of acceptable optional ingredients suitable for use in light-duty liquid detergent composition may be found in U.S. Patent Publ. 2005/0203213 A1 to Pommiers et al. at ¶¶ 128-164.

In one embodiment, where the liquid detergent composition is a liquid laundry detergent one or more of the disclosed adjunct components are included in the formulation. Suitable adjunct components for a liquid laundry detergent include: detersive enzymes, optical brighteners, dye transfer inhibition agents, suds suppressors, detersive soil release polymers, other fabric care benefit agents, stabilizers, ancillary detersive surfactants, detersive builders, perfumes, coloring agents, enzymes, bleaches, mal-odor control agents, antimicrobials, anti-static agents, fabric softening agents, grease cleaning polymers including graft polymers, and combinations of thereof. All of these materials are of the type conventionally utilized in laundry detergent products. They can, however, be delivered to aqueous washing liquors, and/or to fabrics being laundered therein, especially effectively via the compositions of the present invention. Non-limiting examples of suitable laundry adjuncts are provided in U.S. Pat. No. 7,169,741 to Barry et al. at col. 5, line 49 to col. 8, line 15 and col. 19, line 8—col. 20, line 10, U.S. Patent Publ. 2007/0281879A1 to Sharma et al.

8. Process of Making

In one embodiment, the invention provides for a process of making a liquid detergent composition comprising: providing a feed comprising from about 0.005% to about 1.0% by weight of a liquid detergent composition of an external structuring system comprising a bacterial cellulose with a solvent comprising water; activating said feed in a mixing chamber to energy density in excess of about $1.0\times10^5$ J/m$^3$, alternatively from about $2.0\times10^6$ J/m$^3$ to about $5.0\times10^7$ J/m$^3$, to form a bacterial cellulose network; and providing a surfactant system at a level of from about 0.01% to about 70% by weight of said liquid detergent composition, said surfactant system comprising: an anionic surfactant; a nonionic surfactant; a cationic surfactant; an ampholytic surfactant; a zwitterionic surfactant; and mixtures thereof, wherein said step of providing a surfactant system is either performed along with step (a) or after step (b), wherein the step of providing said surfactant system with said bacterial cellulose network forms a liquid matrix having a yield stress of from about 0.003 Pa to about 5.0 Pa at about 25° C. In one embodiment, the process further comprises: adding the suspended particles to the liquid matrix.

As disclosed herein, the step of activating said bacterial cellulose is performed under intense high shear processing conditions such as with an ultra-sonic homogenizer like the SONOLATOR® from Sonic Corp. It has importantly been found that when the bacterial cellulose is activated under a sufficiently intense processing step, the bacterial cellulose network achieved provides enhanced yield stress without requiring additional levels of bacterial cellulose to be added. It is believed that intense high shear processing conditions such as ultra-sonic processing which can create hydrodynamic cavitation (i.e. via a SONOLATOR®) allows the crystalline fibers of the bacterial cellulose to create a more homogenous dispersion of the crystalline fibers. It is believed that the benefit of using intense high shear processing conditions compared to lower energy processes is shown from correlation between process energy density and resultant yield stress. It is believed that where fibers are more thoroughly dispersed during activation, the higher will be the effective volume occupied by the bacterial cellulose network and the degree of interconnectivity within the bacterial cellulose network. Such dispersion difference can be observed under optical microscope since fiber bundles having average lengths of from 1 micron to 20 microns can be observed in conventionally processed samples having an average length below about 2 microns, alternatively below about 1.5 microns.

a. Energy Density

Energy Density is generated by exerting a power density on a feed within the mixing chamber for a residence time. In one embodiment, the process of making the liquid detergent composition comprises: subjecting the bacterial cellulose and a solvent, e.g. water, to an energy density in excess of about $1.0\times10^5$ J/m$^3$, alternatively greater than $2.0\times10^6$ J/m$^3$. In one embodiment, the liquid detergent composition comprises subjecting said bacterial cellulose and water to an energy density from $2.0\times10^6$ J/m$^3$ to about $5.0\times10^7$ J/m$^3$, alternatively from about $5.0\times10^6$ J/m$^3$ to about $2.0\times10^7$ J/m$^3$, or from about $8.0\times10^6$ J/m$^3$ to about $1.0\times10^7$ J/m$^3$.

In one example, a liquid detergent composition is formed using a static mixer, such as Koch/Sulzer Model SMX from Sulzer Corporation at an energy density of from about $1.6\times10^5$ J/m$^3$ to about 4.8 $10^5$ J/m$^3$. In another example, a liquid detergent composition is formed using a high shear mixer, such as an IKA mixer at an energy density of from about 1.0 J/m$^3$ to $2.0\times10^6$ J/m$^3$. In yet another example, a liquid detergent composition is formed using an ultrasonic homogenizer, such as the SONOLATOR®, at an energy density of from about from $7.0\times10^6$ J/m$^3$ to about $4.0\times10^7$ J/m$^3$. Single pass and multipass processing is also within the scope of the invention. Additionally, the step of activation can be performed with any of the above processing techniques as a premix of the bacterial cellulose and solvent prior to contact and subsequent mixing with other ingredients such as the surfactant system or in the presence of one or more other ingredients.

Energy Density can be represented by the equation: $E=W*\Delta T$, where E represents energy density, W represents power density, and $\Delta T$ represents residence time. As defined herein, residence time means the average amount of time a vesicle remains within the mixing chamber. Residence time is determined by calculating the cavity size divided by the flow rate of liquid composition out of the mixing chamber.

b. Power Density and Residence Time

The liquid detergent compositions of the present invention require relatively higher power density than conventional high sheer mixing. As used herein, power density can be determined by the equation: $W=\Delta P/\Delta T$, where W is the Power Density, $\Delta P$ is the applied pressure within the mixing chamber, and $\Delta T$ is the residence time.

In one embodiment, the energy density is generated from a power density of from about 0.5 W/ml to about 100,000 W/ml, alternatively from about 50 W/ml to about 30,000 W/ml. It is observed that the minimum Power Density required to achieve the liquid detergent composition of the present invention is about 0.5 W/ml at 20 kHz.

Where the power density is about 0.5 W/ml, the residence time is about 15 minutes; alternatively, where the power density is about 100,000 W/ml the residence time is about 5 milliseconds. In one embodiment, the residence time is from about 1 millisecond (ms) to about 1 second, alternatively from about 1 ms to about 100 ms, alternatively from about 5 ms to about 50 ms. Further, where the residence time is less than 1 minute, the power density needs to be greater than 10 W/ml. Where the residence time is less than 1 second, the power density needs to be greater than 500 W/ml; alternatively.

Where the residence time is less than 10 ms, the power density needs to be greater than 50,000 W/ml.

After the feed is subjected to the requisite energy, the liquid detergent composition is discharged at a flow rate from about 1 kg/min to about 1000 kg/min, alternatively 10 kg/min to about 500 kg/min. Flow rate can be represented by the equation $Q=30\ A\sqrt{(\Delta P)}$, where Q=flow rate, A=orifice size, and ΔP=pressure within the mixing chamber. As defined herein, orifice size is the orifice cross sectional area. In one embodiment, the orifice size is from about 0.0005 $inches^2$ to 0.1 about $inches^2$.

c. Feed Systems

The liquid detergent composition of the present invention can be manufactured with a variety of feed systems. For example in a single feed system, the components of the liquid detergent composition comprising said bacterial cellulose, said surfactant system, said solvent such as water and other optional ingredients are fed into a mixing chamber as a single feed; where the step of activating said bacterial cellulose to form a bacterial cellulose network occurs in the same step as the mixing of the other components. In another embodiment, the process comprises a dual feed system comprising a first feed comprising the bacterial cellulose and solvent and a second feed comprises a surfactant system and any other components. The feeds are concurrently introduced into the mixing chamber.

In one embodiment one or more of the feeds are premixed prior to entry into the mixing chamber. In another embodiment, one or more of the feeds are not premixed prior to entry into the mixing chamber. In one embodiment, where a dual feed system is used, the first feed comprising the bacterial cellulose and solvent are activated or at least partially activated by premixing prior to introduction into the mixing chamber. In one embodiment, the premix is subjected to intense ultra-sonic processing conditions.

In one embodiment, a premixing step is used to at least partially activate the bacterial cellulose in the presence of aqueous solution to form a first feed. A second feed can be provided comprising the other desired components, such as the surfactants, perfumes, particles, adjunct ingredients, etc. The process comprises: Step 1: activating the bacterial cellulose (optionally in powder form) with water or an aqueous solution, by means of any conventional and well known batch or continuous systems forming a premix of bacterial cellulose. Step 2: The premix of bacterial cellulose and a second feed are mixed together and subjected to the intense high shear processing conditions defined above. Step 3: Product obtained through step 2 is added to the liquid detergent composition in a conventional mixer.

It should be understood that certain particles suitable for use with the compositions herein can be either shear sensitive or intolerant (meaning that they can suffer undesirable structural damage if subjected to intense high shear processing conditions—i.e. microcapsules). In these instances, it could be desirable to add these shear intolerant particles after the step of activating the bacterial cellulose. Additionally, there may be particles which can be abrasive to the mixing chamber and/or vibrating blade of the ultrasonic homogenizer. These abrasive particles can also advantageously be added later in the making process. Other particles which can be damaged by intense high shear processing, and/or be abrasive the mixing apparatus can be added to the feed streams as needed.

9. Turbidity

In one embodiment, the liquid detergent composition comprises a turbidity of below about 320 NTU, alternatively less than about 250 NTU, alternatively less than about 200 NTU, alternatively less than about 150 NTU, alternatively less than about 100 NTU, as measured by Turbimeter test method disclosed herein. Compositions with a turbidity below about 150, alternatively below about 100 are "clear" while those with a turbidity below about 320, alternatively below about 250 are "translucent." In anther embodiment, the liquid detergent composition is pearlescent.

As used herein, turbidity is determined using a Hach Model 2100P Portable Turbidimeter ("Turbimeter"), by Hach Company, Loveland, Colo. StablCal is a trademark of Hach Company.

Turbidimeter Turbidity Method: The Turbidimeter measures the turbidity from 0.01 NTU to 1000 NTU. The Turbidimeter operates on the nephelometric principle of turbidity measurement. The Turbidimeter's optical system includes a tungsten-filament lamp, a 90° detector to monitor scattered light and a transmitted light detector. The Turbidimeter's microprocessor calculates the ratio of the signals from the 90° and of transmitted light detectors. This ratio technique corrects for the interferences from color and or light absorbing materials and compensates for fluctuations in the lamp intensity.

Calibration is by StablCal® Secondary standards provided with the Turbidimeter. The undiluted sample is contained in the sample cell, the outer cell wall is wiped free of water and finger prints. A thin coat of silicone oil is applied to the outer wall of the sample cell in order to mask minor imperfections and scratches on the sample cell wall, which may contribute to turbidity or stray light. A measurement is taken and result is displayed in NTU units. All samples are equilibrated and measured at 25° C. The samples are measured within 24 h after making.

The liquid detergent compositions of the present invention may be packages in any suitable packaging for delivering the liquid detergent composition for use. In one embodiment the package is a clear package made of glass or plastic.

In another embodiment, the liquid detergent composition is packaged in a unit dose pouch, wherein the pouch is made of a water soluble film material, such as a polyvinyl alcohol. In one embodiment the unit dose pouch comprises a single or multi-compartment pouch where the present liquid detergent composition can be used in conjunction with any other conventional powder or liquid detergent composition. Examples of suitable pouches and water soluble film materials are provided in U.S. Pat. No. 6,881,713 to Sommerville-Roberts et al., U.S. Pat. No. 6,815,410 to Boutique et al., and U.S. Pat. No. 7,125,828 to Catlin et al.

10. Measuring the Degree of Connectivity in the Bacterial Cellulose Network as a Result of Processing Conditions Step A: Sample Preparation A drop of sample (approximately 5 μL) is placed on a standard glass microscope slide and spread into a thin film by covering with a standard 22 mm×22 mm coverglass. The edges of the coverglass are then sealed with wax. At least two slide preparations are made from each sample.

The prepared slides are viewed using a compound light microscope (we used a Zeiss AxioVert200), fitted with a CytoViva darkfield condenser system (CytoViva Inc, Alburn, Ala., USA), and an oil immersion 63× objective lens possessing a numerical aperture-reducing iris, as well as 40× and 10× dry objective lenses.

For node quantification, thirty representative images of each sample preparation are captured, at each of two magnifications (400× and 630×) using a digital CCD camera, (we used a monochrome 12 bit Zeiss AxioCam MRm version 3, with 2×2 binning, calibrated for length scale (pixels per micrometer) (we used Zeiss AxioVision software). Ten low magnification (100×) images of each sample are also captured, using a traditional condenser darkfield patchstop or mismatched phase rings, and long camera exposure times, to assess the overall homogeneity of the fiber network.

Step B: Image Analysis

The number of nodes (fiber intersections) per image is determined using the free image analysis software, Image J (National Institutes of Health, Bethesda, Md.).

Images are first processed by application of algorithms for smoothing, background subtraction and contrast enhancement. The images are then thresholded (so that all fibers are shown in a binarized image with the background being the liquid medium). Those of skill in the art will understand that different samples will require different threshold settings based on the formulation being imaged as well as the imaging equipment used. Threshold setting is described in detail in The Image Processing Handbook, 4$^{th}$ Edition, 2002, by John C. Russ, published by CRC Press LLC, Boca Raton, Fla., ISBN 0-8493-1142-X. Those of skill in the art will understand that the threshold range should be adjusted to maximize selection of fiber pixels and minimize selection of background noise. The thresholded images are then processed with the skeletonization algorithm.

Image Analysis Processing Steps (Image J)

1. Open Image
2. Process→Smooth
3. Process→Subtract Background (Sliding Paraboloid; 10 pixels)
4. Process→Enhance Contrast (Normalize, 0.5% pixels)
5. Image→Adjust→Threshold
6. Image→Lookup→Tables→Invert LUT
7. Edit→Invert
8. Process→Binary→Skeletonize Step C: Calculating Number of Node Points:

Numerical data on the number of node points in each skeletonized image are extracted using the Image J macro/module provided below as Program A (in java) and exported into a spreadsheet for statistical analyses.

Program A:

```
import ij.*;
import ij.process.*;
import ij.gui.*;
import java.awt.*;
import ij.plugin.filter.*;
import java.util.*;
import java.math.*;
import ij.text.*;
/**
 * Works on full images only, expects black skeleton on white background
 * @author Bob Reeder
 */
public class Node_Count implements PlugInFilter {
        ImagePlus imp;
    private boolean remove_isolated_pixels = true;
    private ArrayList<Point> isolatedPixels = new ArrayList<Point> (1000);
    private ArrayList<Point> endpointPixels = new ArrayList<Point> (1000);
    private ArrayList<Point> nodePixels = new ArrayList<Point> (1000);
    private ImageProcessor imageCopy;
    private ImageProcessor imagePadded;
      public int setup(String arg, ImagePlus imp) {
              this.imp = imp;
              return DOES_ALL;
      }
      public void run(ImageProcessor ip) {
        TextWindow output = new TextWindow( "Output Window", " ", 200, 50 );
        imageCopy = ip.createProcessor( ip.getWidth( ), ip.getHeight( ) );
        imageCopy = ip.duplicate( );
        imagePadded = ip.createProcessor( ip.getWidth( )+2, ip.getHeight( )+2 );
        imageCopy.invert( );
        imageCopy = binarizeImage( imageCopy );
        imagePadded = padImage( imageCopy, 0 );
        imagePadded = classifyPixels( imagePadded, isolatedPixels, endpointPixels, nodePixels );
        imagePadded = fixNodes( imagePadded, 4, nodePixels );
        ImagePlus imp2= new ImagePlus( "Fixed Nodes", imagePadded);
        imp2.setDisplayRange( 0.0, 5.0 );
        imp2.show( );
        output.append( "Total Number of Nodes: " + nodePixels.size( ) + "\n" );
        output.append( "Total Number of Endpoints: " + endpointPixels.size( ) + "\n" );
        }
    /** Converts image to true binary
     * i. e. 0 stays 0, all other values converted to 1
     * (Written: 11/21/08)
     * @param ImageProcessor imageProc -- ImageProcessor to binarize
     * @return Object containing binarized image
     */
    private ImageProcessor binarizeImage( ImageProcessor imageProc ) {
      ImageProcessor tmpImageProc;
      tmpImageProc = imageProc.createProcessor( imageProc.getWidth( ), imageProc.getHeight( ) );
```

-continued

Program A:

```
    for( int i=0; i<imageProc.getWidth( ); i++ ) {
        for( int j=0; j<imageProc.getHeight( ); j++ ) {
            tmpImageProc.putPixel( i, j, (imageProc.getPixel(i,j) == 0) ? 0 : 1 );
        }
    }
    return( tmpImageProc );
}
/** Expands image by 2 pixels in each direction and fills border with padValue
* (Written: 11/21/08)
* @param ImageProcessor imageProc : ImageProcessor to pad
* @param int padValue -- value to place in border
* @return Object containing padded image
*/
private ImageProcessor padImage( ImageProcessor imageProc , int padValue ) {
    int imageWidth = imageProc.getWidth( ) + 2;
    int imageHeight = imageProc.getHeight( ) + 2;
    ImageProcessor tmpImageProc;
    tmpImageProc = imageProc.createProcessor( imageWidth, imageHeight );
    for( int i=0; i< imageWidth; i++ ) {
        for( int j=0; j< imageHeight; j++ ) {
            if( (0 == i) || ((imageWidth−1) == i) || (0 == j) || ((imageHeight − 1) == j))
                tmpImageProc.putPixel( i, j, padValue);
            else
                tmpImageProc.putPixel( i, j, imageProc.getPixel( i−1, j−1 ));
        }
    }
    return( tmpImageProc );
}
/**Classify pixels according to level of connection
 * (Written 11/21/08)
 * @param imageProc -- image processor to work on
 * @param isolatedPixelsCoords -- array to store 0 connected pixel coordinates
 * @param endpointPixelCoords -- array to store 1 connected pixel coordinates
 * @param nodePixelCoords -- arary to store 3 or more connected pixel coordinates
 * @return Object containing classification map
 */
private ImageProcessor classifyPixels( ImageProcessor imageProc,
                        ArrayList<Point> isolatedPixelsCoords,
                        ArrayList<Point> endpointPixelCoords,
                        ArrayList<Point> nodePixelCoords ) {
    int connectionValue = 0;
    int connectionValue2 = 0;
    isolatedPixelsCoords.clear( );
    endpointPixelCoords.clear( );
    nodePixelCoords.clear( );
    ImageProcessor tmpImageProc;
    tmpImageProc = imageProc.createProcessor( imageProc.getWidth( ), imageProc.getHeight( ) );
    for(int i=1; i < imageProc.getWidth( )−1; i++){
        for( int j=1; j < imageProc.getHeight( )−1; j++){
            if( 0 == imageProc.getPixel( i, j))
                {
                tmpImageProc.putPixel(i, j, 0);
                }
            else
                {
                connectionValue = 0;
                connectionValue2 = 0;
                connectionValue = imageProc.getPixel(i−1, j−1) +
                        imageProc.getPixel(i, j−1)    +
                        imageProc.getPixel(i+1, j−1) +
                        imageProc.getPixel(i−1, j) +
                        imageProc.getPixel(i+1, j)    +
                        imageProc.getPixel(i−1, j+1)    +
                        imageProc.getPixel(i, j+1)    +
                        imageProc.getPixel(i+1, j+1);
                connectionValue2 = imageProc.getPixel(i−2, j−2) +
                        imageProc.getPixel(i−1, j−2) +
                        imageProc.getPixel(i, j−2)    +
                        imageProc.getPixel(i+1, j−2) +
                        imageProc.getPixel(i+2, j−2) +
                        imageProc.getPixel(i+2, j−1) +
                        imageProc.getPixel(i+2, j)    +
                        imageProc.getPixel(i+2, j+1) +
                        imageProc.getPixel(i+2, j+2) +
                        imageProc.getPixel(i+1, j+2) +
                        imageProc.getPixel(i, j+2)    +
                        imageProc.getPixel(i−1, j+2) +
                        imageProc.getPixel(i−2, j+2) +
```

-continued

Program A:

```
                    imageProc.getPixel(i−2, j+1) +
                    imageProc.getPixel(i−2, j)    +
                    imageProc.getPixel(i−2, j−1);
            /* if( connectionValue2 < connectionValue && connectionValue > 2)
               connectionValue−−;
            */
            switch( connectionValue)
            {
               case 0: {
                  isolatedPixelsCoords.add(new Point( i, j));
                  tmpImageProc.putPixel( i, j, connectionValue);
                 break;
               }
               case 1: {
                  if( !((1 == i) || (1 == j) || ((tmpImageProc.getWidth( )−2) == i) ||
((tmpImageProc.getHeight( )−2) == j)) ) {
                     tmpImageProc.putPixel( i, j, connectionValue);
                     endpointPixelCoords.add(new Point( i, j));
                  }
                  break;
               }
               case 2: {
                  tmpImageProc.putPixel( i, j, connectionValue);
                  break;
               }
               case 3: {
                  nodePixelCoords.add(new Point( i, j));
                  tmpImageProc.putPixel( i, j, connectionValue);
                  break;
               }
               case 4: {
                  nodePixelCoords.add(new Point( i, j));
                  tmpImageProc.putPixel( i, j, connectionValue);
                  break;
               }
               case 5: {
                  nodePixelCoords.add(new Point( i, j));
                  tmpImageProc.putPixel( i, j, connectionValue);
                  break;
               }
               case 6: {
                  nodePixelCoords.add(new Point( i, j));
                  tmpImageProc.putPixel( i, j, connectionValue);
                  break;
               }
               case 7: {
                  nodePixelCoords.add(new Point( i, j));
                  tmpImageProc.putPixel( i, j, connectionValue);
                  break;
               }
               case 8: {
                  nodePixelCoords.add(new Point( i, j));
                  tmpImageProc.putPixel( i, j, connectionValue);
                  break;
               }
               default: {
                  break;
               }
            }   // end switch
            }   // end else
         } // end for j
      } // end for i
   return( tmpImageProc );
}
/**
 * Reduces number of 3 or more connected pixels at nodes to a single pixel
 * chosen by selecting the pixel closest to the center of mass of the cluster of pixels.
 * (Written 11/22/08)
 * @param imageProc: ImageProcessor to operate on
 * @param radius: radius to search when looking for adjacent 3 connected pixels
 * @param nodePixelCoords: array containg the list of 3 or more connected pixels
 * @return modified ImageOricessor showing new connections
 * Note: nodePixelCoordinates array is updated to reflect the new nodes
 */
private ImageProcessor fixNodes( ImageProcessor imageProc, int radius, ArrayList<Point> nodePixelCoords
) {
   double dist;
   double minDist = 0;
```

-continued

Program A:

```
        double xSum = 0;
        double ySum = 0;
        Point centerOfMassPixel = new Point(0,0);
        int nNeighbors = 0;
        Point coord1 = new Point( 0, 0 );
        Point coord2 = new Point( 0, 0 );
        ArrayList<Point> neighborList = new ArrayList<Point> (50);
        ImageProcessor tmpImageProc;
        tmpImageProc = imageProc.createProcessor( imageProc.getWidth( ), imageProc.getHeight( ) );
        tmpImageProc = imageProc.duplicate( );
        radius *= radius;
        for( int i=0; i< nodePixelCoords.size( ); i++ ) {
          nNeighbors=0;
          neighborList.clear( );
          coord1 = nodePixelCoords.get(i);
          neighborList.add(coord1);
          xSum = coord1.x;
          ySum = coord1.y;
          tmpImageProc.putPixel( coord1.x, coord1.y, 2 );
          for( int j=i+1; j< nodePixelCoords.size( ); j++ ) {
            coord2 = nodePixelCoords.get(j);
            /* dist = (int)Math.round(coord1.distance( coord2 )); */
            dist = (coord1.x − coord2.x) * (coord1.x − coord2.x) + (coord1.y − coord2.y) * (coord1.y −
coord2.y);
            if( dist < radius ) {
              nNeighbors++;
              xSum += coord2.x;
              ySum += coord2.y;
              neighborList.add(coord2);
              tmpImageProc.putPixel( coord2.x, coord2.y, 2 );
              nodePixelCoords.remove(j);
              j−=1;
            }
          } // end for j
          centerOfMassPixel.x = (int)Math.round(xSum/(nNeighbors+1));
          centerOfMassPixel.y = (int)Math.round(ySum/(nNeighbors+1));
          coord2 = neighborList.get(0); // assume first pixel is closest pixel
          /* minDist = coord2.distance( centerOfMassPixel ); */
          minDist = (coord2.x − centerOfMassPixel.x) * (coord2.x − centerOfMassPixel.x) +
                (coord2.y − centerOfMassPixel.y) * (coord2.y − centerOfMassPixel.y);
          if( neighborList.size( ) > 1 ) {
            for( int k = 1; k < neighborList.size( ); k++ ) {
              coord1 = neighborList.get(k);
              /* dist = coord1.distance( centerOfMassPixel ); */
              dist = (coord1.x − centerOfMassPixel.x) * (coord1.x − centerOfMassPixel.x) +
                    (coord1.y − centerOfMassPixel.y) * (coord1.y − centerOfMassPixel.y);
              if( dist < minDist )
                coord2 = coord1;
              }
            }
          tmpImageProc.putPixel( coord2.x, coord2.y, 3 );
          nodePixelCoords.set( i, coord2); // Update array to reflect new nodes
        } // end for i
      return( tmpImageProc );
      }
      } // end class
```

In one embodiment, the degree of fiber connectivity is quantified by determining the mean number of nodes (fiber intersections) in 30 representative images at two different magnifications (400× & 630×). It has importantly been found that node counts per image are significantly lower in High Shear Mixing samples (HSM) prepared using a rotor stator device generating an energy density of $2*10^6$ J/m$^3$ than in samples processed under intense high shear processing conditions using a single pass fed system with a SONOLATOR® at 5000 psi generating an energy density of $3.5*10^7$ J/m$^3$, indicating a lower connectivity of the fiber network. Without intending to be bound by theory, it is believed that the degree of connectivity quantified by determining the average number of nodes is also consistent with a lower yield stress measured in the HSM sample (0.006 Pa) as compared to the yield stress measured in the sample processed under intense high shear processing condition using a single pass fed system with a SONOLATOR® at 5000 psi (0.014 Pa). A higher degree of fiber connectivity results in a higher yield stress and consequently in better suspending properties in the final product.

A Standard Mean Nodes/μm$^2$ Image Area per bacterial cellulose concentration (hereinafter "SMNI Index") is calculated by the following formula: (Mean Nodes determined for an image/image size in μm$^2$)/(weight % bacterial cellulose) As such, in one embodiment, the bacterial cellulose network of the present invention comprises a SMNI Index of at least about 0.099, at least about 0.105, at least about 0.110, at least about 0.15, at least about 0.2. In another embodiment, the SMNI index can be up to about 1.

Figure 3:
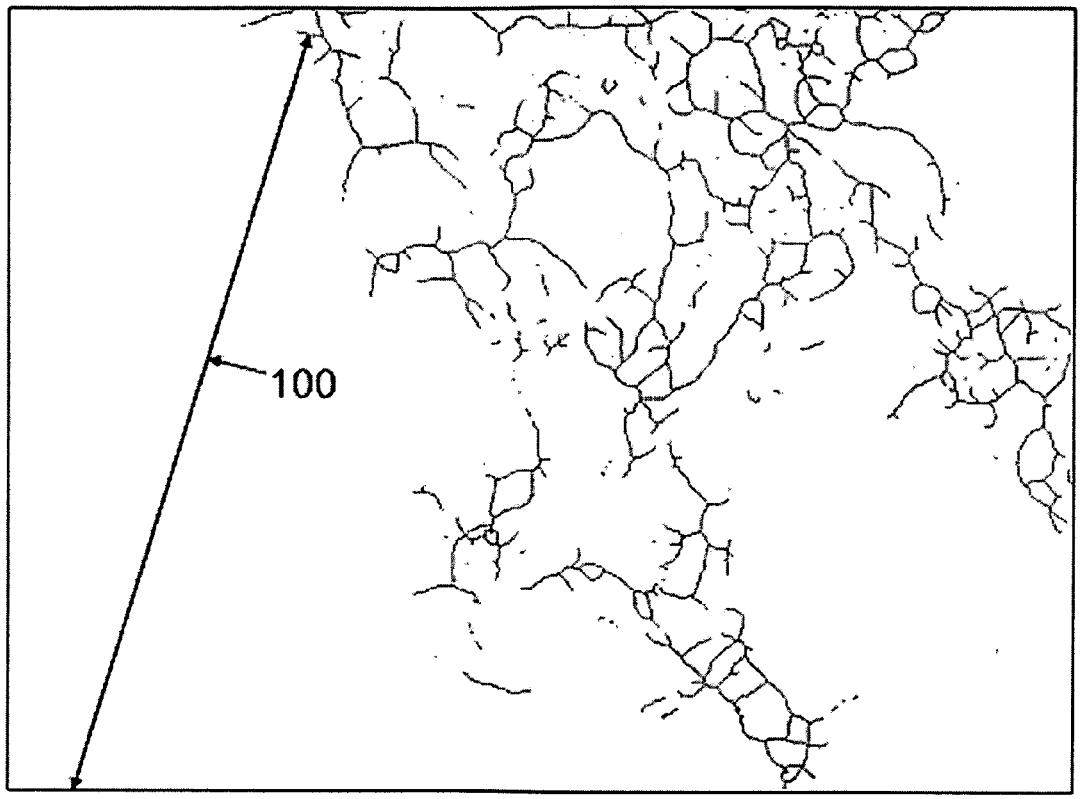
FIG. 3 shows an exemplary figure of a liquid detergent composition comprising 0.036 weight % of a bacterial cellulose network prepared using a rotor stator device generating an energy density of $2*10^6$ J/m$^3$, imaged under 400× magnification via CytoViva Darkfield Light Microscopy.
Figure 4:
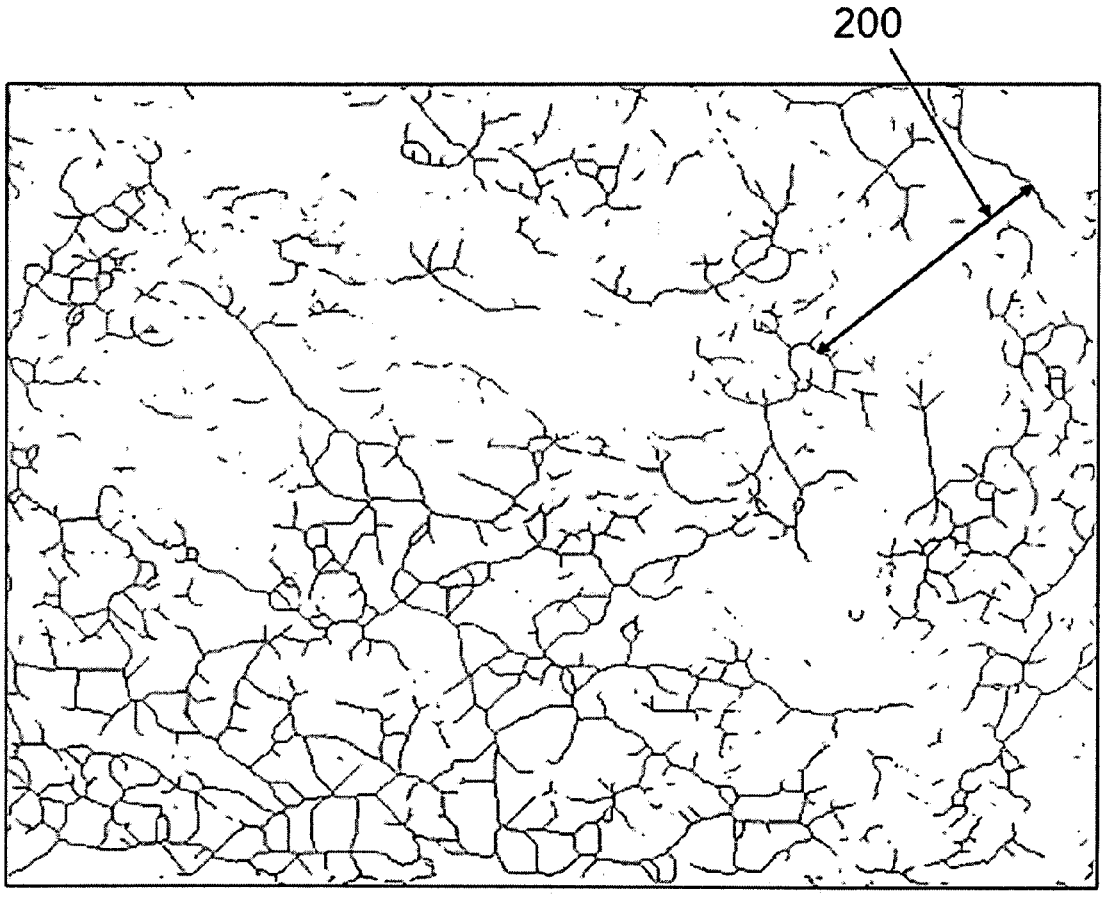
FIG. 4 shows an exemplary figure of a liquid detergent composition comprising 0.036 weight % of a bacterial cellulose network prepared using a single pass fed system with a SONOLATOR® at 5000 psi generating an energy density of $3.5*10^7$ J/m$^3$, imaged under 400× magnification via CytoViva Darkfield Light Microscopy.
Figure 5:
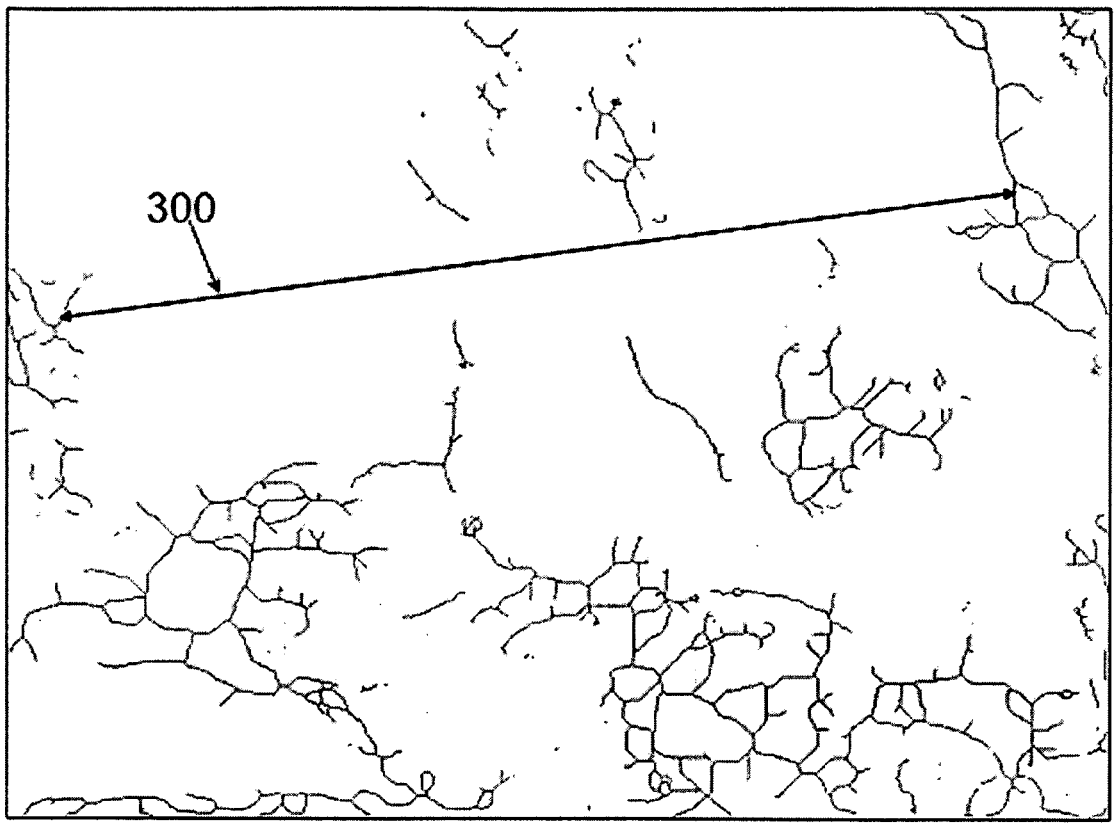
FIG. 5 shows an exemplary figure of the same sample imaged in FIG. 3 under 630× magnification via CytoViva Darkfield Light Microscopy.
Figure 6:
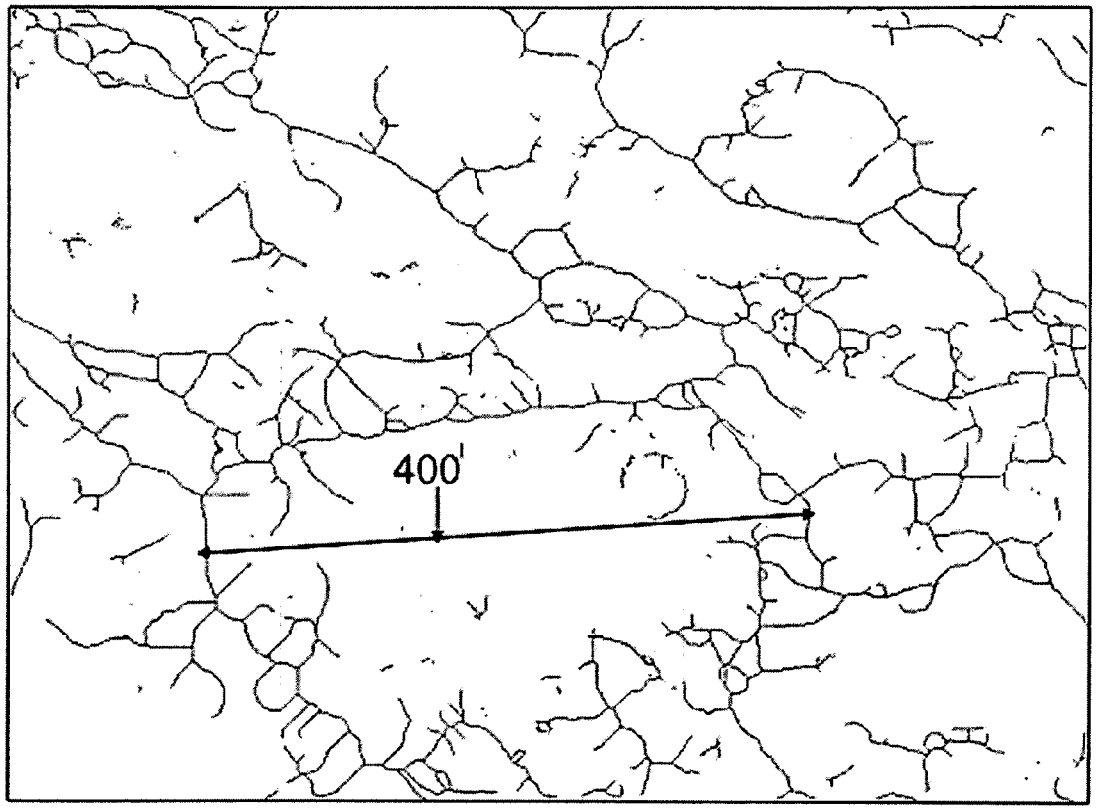
FIG. 6 shows an exemplary figure of the same sample imaged in FIG. 4, imaged under 630× magnification via CytoViva Darkfield Light Microscopy.

FIG. 3 provides one example skeletonized image of the HSM sample having 233 nodes/image viewed under 400× magnification (447 μm×336 μm). Distance 100 points out a straight line distance between the boundary of the image and a portion of the skeletonized fiber network. FIG. 4 provides one example skeletonized image of a sample processed under intense processing conditions having 639 nodes/image viewed under 400× magnification. Distance 200 demonstrates a straight line distance between two portions of the skeletonized fiber network. FIG. 5 provides another skeletonized image of the sample imaged in FIG. 3, having 279 nodes/image viewed under 630× magnification (284 μm×213 μm). Distance 300 demonstrates a straight line distance between two portions of the skeletonized fiber network. FIG. 6 provides another skeletonized image of the sample imaged in FIG. 4, having 367 nodes/image viewed under 630× magnification. Distance 400 demonstrates a straight line distance between two portions of the skeletonized fiber network. The samples shown in FIGS. 3-6 are made with 0.036 wt % bacterial cellulose. It is believed that these exemplary images show how the processing conditions impact the connectivity of the bacterial cellulose fibers holding the formulations constant. Without intending to be bound by theory, it is believed that the increased connectivity allows for enhanced rheology benefits including increased yield stress and bead suspension capabilities. Further distances 100, 200, 300 and 400 are provided merely for illustrative purposes of how one would measure a straight line distance between two points of the skeletonized bacterial fiber network, when viewed under varying magnifications.

Samples:

Separate samples made in accordance with Example 3, below, except with 0.036 wt % bacterial cellulose, 0.018 Xanthum Gum, and 0.006 CMC are made via HSM and intense high shear processing conditions. The node calculations are provided below in Tables 1 and 2. At 400× magnification: 340 mean nodes/image (447 μm×336 μm=150,192 $\mu m^2$) by HSM (having an SMNI Index of 0.0629). vs. 580 mean nodes/image (447 μm×336 μm) by intense high shear processing conditions (having an SMNI Index of 0.107). At 630× magnification: 214 mean nodes/image (284 μm×213 μm=60,492 $\mu m^2$) by HSM (having an SMNI Index of 0.0983), vs. 343 mean nodes/image (284 μm×213 μm) by intense high shear processing conditions (having an SMNI Index of 0.158). In one embodiment, the bacterial cellulose network comprises a mean node of from about 350 mean nodes/image (447 μm×336 μm), alternatively greater than about 500 mean nodes/image, alternatively greater than 580 mean nodes/image, alternatively greater than about 600 mean nodes/image. In another embodiment, the bacterial cellulose network comprises a mean node of from about 210 mean nodes/image (284 μm×213 μm) alternatively greater than about 300 mean nodes/image, alternatively greater than 350 mean nodes/image, alternatively greater than about 400 mean nodes/image.

Lower fiber connectivity in the HSM sample was also reflected in a higher coefficient of variation (CV) of node number. At 400× magnification: 39% CV by HSM, vs. 18% CV by sonolation. At 630× magnification: 59% CV by HSM, vs. 22% CV by sonolation. The CV values calculated herein are determined based on the relative difference in the mean nodes observed for a given image area for a given sample. It is believed that the CV between samples made via different processing conditions should be consistent across varying weight % of the bacterial cellulose. The CV as used herein is the ratio of the standard deviation to the mean as a percentage, (standard deviation/mean×100), for a given magnification, and therefore provides a relative measure of variation between data series. CV400 is the ratio at a magnification of 400×. Without intending to be bound it is believed that although the mean nodes/image can be impacted by the threshold setting. The CV, however, should be less sensitive to variations in the threshold setting. In one embodiment, the bacterial cellulose network comprises a CV400 and/or the CV630 is from about 10% to about 39%, alternatively from about 15% to about 25%, alternatively about 20%.

Lower fiber connectivity in the High Shear samples can be easily observed via the low magnification (400×) darkfield images. In these images, numerous large voids/breaks in the fiber network can be observed in the High Shear samples, while the fiber network samples which are activated under intense high shear processing conditions appears dense and homogeneous, without breaks or voids in the fiber network. In one embodiment, when viewed under 400× darkfield imaging, the greatest straight line distance between two points of the skeletonized bacterial fiber network (or between the boundary of the image and one point on the network) is less than about 250 microns in length, alternatively less than about 100 microns, alternatively less than about 50 microns, alternatively less than about 15 microns, alternatively less than about 5 microns.

TABLE 1

Samples prepared and viewed at 400x magnification

| Sample | HSM | | Intense High Shear Procesing | |
|---|---|---|---|---|
| Number | Image | Node # | Image | Node # |
| 1 | 0043 | 338 | 0008 | 598 |
| 2 | 0044 | 236 | 0012 | 542 |
| 3 | 0045 | 284 | 0013 | 557 |
| 4 | 0046 | 450 | 0014 | 633 |
| 5 | 0047 | 332 | 0015 | 670 |
| 6 | 0049 | 279 | 0016 | 498 |
| 7 | 0050 | 267 | 0017 | 530 |
| 8 | 0051 | 459 | 0018 | 578 |
| 9 | 0052 | 208 | 0019 | 772 |
| 10 | 0053 | 361 | 0020 | 572 |
| 11 | 0054 | 265 | 0021 | 615 |
| 12 | 0055 | 309 | 0022 | 717 |
| 13 | 0056 | 275 | 0023 | 663 |
| 14 | 0057 | 422 | 0024 | 739 |
| 15 | 0058 | 204 | 0026 | 414 |
| 16 | 0059 | 352 | 0027 | 689 |
| 17 | 0060 | 277 | 0028 | 528 |
| 18 | 0061 | 289 | 0029 | 618 |
| 19 | 0062 | 493 | 0030 | 368 |
| 20 | 0063 | 553 | 0031 | 563 |
| 21 | 0064 | 606 | 0032 | 441 |
| 22 | 0065 | 320 | 0033 | 436 |
| 23 | 0066 | 132 | 0034 | 653 |
| 24 | 0067 | 233 | 0035 | 437 |
| 25 | 0068 | 301 | 0036 | 639 |
| 26 | 0069 | 261 | 0038 | 692 |
| 27 | 0070 | 382 | 0039 | 460 |

TABLE 1-continued

| Samples prepared and viewed at 400x magnification | | | | |
|---|---|---|---|---|
| Sample | HSM | | Intense High Shear Procesing | |
| Number | Image | Node # | Image | Node # |
| 28 | 0071 | 191 | 0040 | 572 |
| 29 | 0072 | 765 | 0041 | 568 |
| 30 | 0073 | 364 | 0042 | 642 |
| Mean Nodes | | 340 | | 580 |
| Standard Deviation | | 134 | | 102 |
| CV | | 39.26 | | 17.55 |

TABLE 2

| Sample | HSM | | Intense High Shear Procesing | |
|---|---|---|---|---|
| Number | Image | Node # | Image | Node # |
| 1 | 0074 | 406 | 0105 | 403 |
| 2 | 0075 | 193 | 0106 | 424 |
| 3 | 0076 | 117 | 0107 | 259 |
| 4 | 0077 | 7 | 0108 | 336 |
| 5 | 0078 | 248 | 0109 | 331 |
| 6 | 0079 | 254 | 0110 | 279 |
| 7 | 0080 | 150 | 0111 | 315 |
| 8 | 0081 | 311 | 0112 | 514 |
| 9 | 0082 | 128 | 0113 | 261 |
| 10 | 0083 | 248 | 0114 | 269 |
| 11 | 0084 | 263 | 0115 | 271 |
| 12 | 0085 | 1 | 0116 | 370 |
| 13 | 0086 | 304 | 0117 | 417 |
| 14 | 0087 | 666 | 0118 | 397 |
| 15 | 0088 | 198 | 0119 | 397 |
| 16 | 0089 | 126 | 0120 | 262 |
| 17 | 0090 | 282 | 0121 | 248 |
| 18 | 0091 | 205 | 0122 | 295 |
| 19 | 0092 | 153 | 0123 | 514 |
| 20 | 0093 | 146 | 0124 | 320 |
| 21 | 0094 | 302 | 0125 | 234 |
| 22 | 0095 | 323 | 0126 | 348 |
| 23 | 0096 | 172 | 0127 | 278 |
| 24 | 0097 | 164 | 0128 | 358 |
| 25 | 0098 | 290 | 0129 | 273 |
| 26 | 0099 | 279 | 0130 | 357 |
| 27 | 0100 | 149 | 0131 | 441 |
| 28 | 0101 | 106 | 0132 | 389 |
| 29 | 0102 | 88 | 0133 | 374 |
| 30 | 0103 | 147 | 0134 | 367 |
| Mean Nodes | | 214 | | 343 |
| Standard Deviation | | 127 | | 75 |
| CV | | 59.16 | | 21.86 |

11. Examples

Any of the following examples can be packaged in water-soluble film pouch as a unit dose. Those of skill in the art will understand that the % bacterial cellulose is representative of the weight % of bacterial cellulose network formed after activation.

Example 1

A liquid detergent composition in accordance with the present invention is prepared in the following proportions.

| | % by Wt. |
|---|---|
| Alkylbenzenesulfonic acid | 23.2 |
| Nonionic alcohol ethoxylate C24 EO7 | 16.9 |
| C12-18 fatty acid | 18.2 |
| Protease | 1.2 |
| Silicone oil | 1.1 |
| Optical brightener | 0.27 |
| Propylene glycol | 13.5 |
| Glycerol | 7.1 |
| Monoethanolamine | 6.9 |
| Caustic soda | 1.0 |
| Potassium Sulfite | 0.2 |
| Perfume | 1.4 |
| Pearlescent agent (TiO2 coated Mica) | 0.05 |
| Dyes | ppm |
| Bacterial cellulose | 0.1 |
| Water & minors | Balance to 100 |

Example 2

Heavy duty Liquid Laundry Detergent in accordance with the present invention are prepared in the following proportions.

| | |
|---|---|
| C12Linear Alkylbenzene Sulphonate | 7.9 |
| Nonionic alcohol ethoxylate C14-15 EO8 | 5.7 |
| C12-14 Amine Oxide | 1 |
| Citric Acid | 2 |
| C12-18 Fatty Acid | 5.2 |
| Enzymes (Protease, Amylase, Mannanase) | 0.6 |
| MEA-Borate | 1.5 |
| Chelant (DTPMP) | 0.2 |
| Ethoxylated Polyamine Dispersants | 1.2 |
| Silicone/Silica Suds Suppressors | 0.002 |
| Ethanol | 1.4 |
| Propane Diol | 5 |
| NaOH | 3.2 |
| Bacterial Cellulose | 0.1 |
| Suspension Particles in accordance with U.S. Pat. No. 7,169,741 Col. 22, Example II | 1 |
| Perfume, Brightener, Hydrotrope, Colorants, Other Minors | 4.2 |
| Water | Balance to 100 |

Example 3-8

Light Duty Liquid Detergents in accordance with the present invention are prepared in the following proportions.

| INGREDIENT | Example 3 % by Wt. | Example 4 % by Wt. | Example 5 % by Wt. | Example 6 % by Wt. | Example 7 % by Wt. | Example 8 % by Wt. |
|---|---|---|---|---|---|---|
| Alkyl ethoxylated sulphate sodium salt EO 0.5-1 | 17.85 | 26.97 | 26.97 | 26.97 | 20.25 | 20.25 |

-continued

| INGREDIENT | Example 3 % by Wt. | Example 4 % by Wt. | Example 5 % by Wt. | Example 6 % by Wt. | Example 7 % by Wt. | Example 8 % by Wt. |
|---|---|---|---|---|---|---|
| Amine Oxide | 5.95 | 5.61 | 5.61 | 5.61 | 6.65 | 6.65 |
| Nonionic alcohol ethoxylate C11EO9 | 0.00 | 2.21 | 2.21 | 2.21 | 0.00 | 0.00 |
| Polycarboxylate Polymer | 0.39 | 0.00 | 0.00 | 0.00 | 0.39 | 0.39 |
| Polypropylene Glycol | 0.50 | 0.80 | 0.80 | 0.80 | 1.00 | 1.00 |
| Solvent (ethanol) | 1.50 | 3.69 | 3.69 | 3.69 | 0.00 | 0.00 |
| Salt NaCl | 0.50 | 1.60 | 1.60 | 1.60 | 1.20 | 1.20 |
| Bacterial Cellulose | 0.03 | 0.024 | 0.024 | 0.024 | 0.03 | 0.06 |
| Carbomethyl Cellulose | 0.015 | 0.012 | 0.012 | 0.012 | 0.015 | 0.03 |
| Xanthan Gum | 0.005 | 0.004 | 0.004 | 0.004 | 0.005 | 0.01 |
| Pearlescent (EGDS) | 2.00 | 0.00 | 0.00 | 0.00 | 0.00 | 2.00 |
| Perfume Micro Capsules | 0.00 | 0.00 | 0.00 | 0.00 | 1.00 | 0.00 |
| ISP Captivates HC1955 from ISP Corp | 0.00 | 0.10 | 0.00 | 0.00 | 0.00 | 0.00 |
| ISP MicroBead 20305 from ISP Corp | 0.00 | 0.00 | 0.10 | 0.00 | 0.00 | 0.00 |
| Lipo LTI-0526 Bead from Lipo Chemicals Inc. | 0.00 | 0.00 | 0.00 | 0.10 | 0.00 | 0.00 |
| Water + adjuncts such as perfume and dye | balance | balance | balance | balance | balance | balance |
| pH at 10% dilution | 8.90 | 9.00 | 9.00 | 9.00 | 9.00 | 9.00 |

Example 9-10

Shampoo compositions in accordance with the present invention are prepared in the following proportions.

| Ingredient | Example 9 Wt. % Active | Example 10 Wt. % Active |
|---|---|---|
| Sodium Laureth Sulfate | 5.0000 | 0 |
| Sodium Lauryl Sulfate | 9.0000 | 0 |
| Ammonium Laureth Sulfate | 0 | 10.0000 |
| Ammonium Lauryl Sulfate | 0 | 6.0000 |
| Polydimethyl siloxane | 1.0000 | 2.0000 |
| Glycol distearate | | 1.5000 |
| Bacterial Cellulose | 0.5000 | 0.0500 |
| Polyquaternium 10 (LR400) (Available from Americhol) | 0.5000 | 0 |
| Mirapol 100 (Polyquaternium 6) (Available from Rhodia) | 0 | 0.0500 |
| Cocodimethyl amide | 0.8000 | 0.8000 |
| Brij 30 (Laureth-4) | 1.0000 | 1.0000 |
| NaOH | as needed | as needed |
| Sodium Benzoate | 0.2500 | 0.2500 |
| Disodium EDTA | 0.1274 | 0.1274 |
| Citric Acid | 0.5000 | 0.5000 |
| NaCl | as needed | as needed |
| Sodium Xylene Sulfonate | as needed | as needed |
| Kathon CG (Methylchloroisothiazolinone and Methylisothiazolinone) | 0.0005 | 0.0005 |
| Perfume/colors/other minors | as needed | as needed |
| Water | balance | balance |

12. Detailed Description of the Figures

FIG. 1 shows a plot of % bacterial cellulose to yield stress obtained by activating a sample in accordance with Example 5 wherein the % bacterial cellulose is varied up to 0.1% with varying processing techniques. Line 10 represents the linear extrapolation for test A; Line 20 represents the linear extrapolation for Test B; and Line 30 represents the linear extrapolation for Test C.

Test A: Two step process 1) premix of bacterial cellulose and water with SONOLATOR® at an energy density of about $7.155\times10^6$ J/m$^3$ a premix solution followed by 2) mixing of premix solution with the other components in a SONOLATOR® at 5000 psi providing an energy density of about $3.47\times10^7$ J/m$^3$. Solid squares represent experimental data points while the empty square represents an extrapolated data point, determined by a scaled extrapolation comparing the Test A data point at 0.06% bacterial cellulose vs. the Test B data point at 0.06% bacterial cellulose. A straight line extrapolation is fit to the three data points.

Test B: One step process: Activation and mixing in 1 pass in a SONOLATOR® at 5000 psi providing an energy density of about $3.47\times10^7$ J/m$^3$. All three Test B data points were obtained experimentally. Data is represented by circles plotted on chart with a straight line extrapolation fit to the data points.

Test C: One step process: Activation and mixing in a high shear mixer set at 7900 rpm, providing an energy density of about $2\times10^6$ J/m$^3$. Both Test C data points were obtained experimentally. Data is represented in triangles plotted on chart with a straight line extrapolation fit to the data points.

Figure 2:
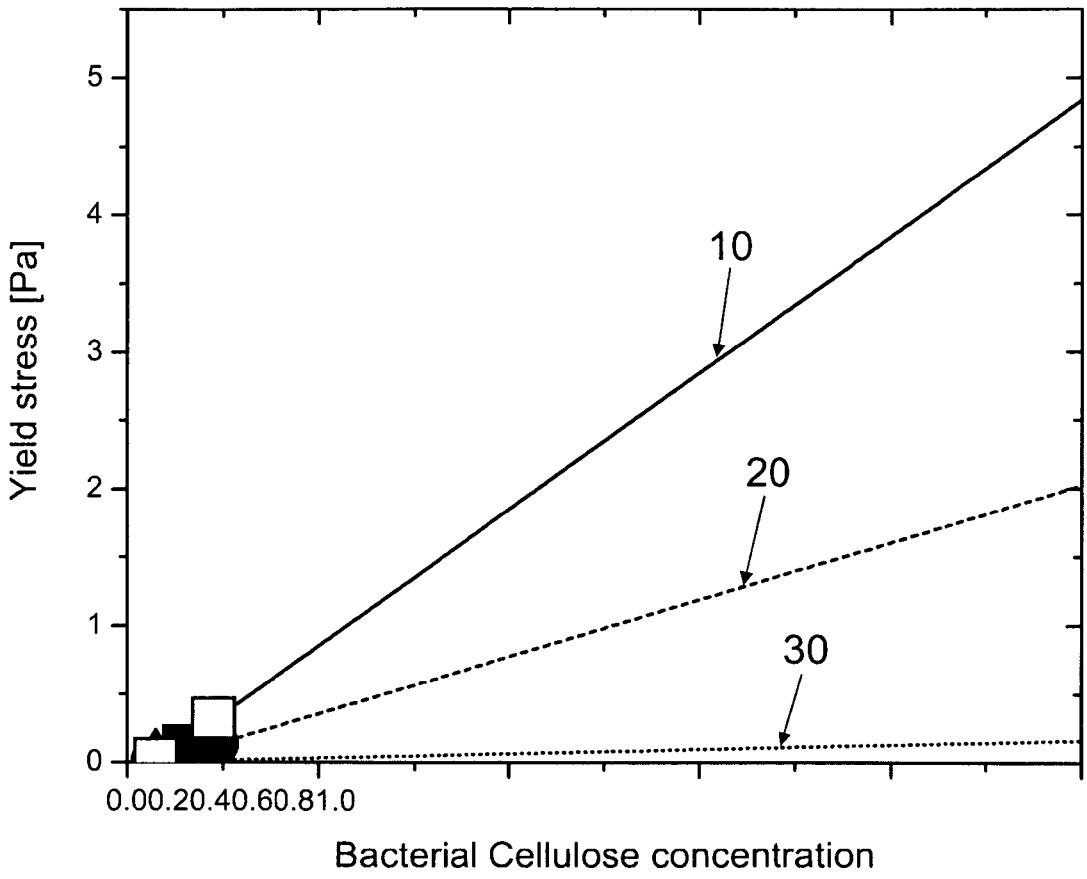
FIG. 2 shows a graphical representation based on the same data as used in FIG. 1 with the extrapolation of yield stress for up to 1% bacterial cellulose concentration.

FIG. 2 shows a linear extrapolation of the % bacterial cellulose network to yield stress for bacterial cellulose network concentration above about 0.1% processed with the same three techniques described in FIG. 1. Note that the same data points are used in both FIGS. 1 and 2.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Except as otherwise noted, the articles "a," "an," and "the" mean "one or more."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

a. a liquid matrix comprising:

i. from about 0.005% to about 1.0% by weight of said liquid detergent composition of an external structuring system comprising a bacterial cellulose network;

ii. from about 1% to about 75% by weight of said liquid detergent composition of water;

iii. from about 0.01% to about 70% by weight of said liquid detergent composition of a surfactant system comprising from about 5% to about 60% of an anionic surfactant and from about 0.1% to about 25% of amine oxide; and iv. from about 0.01% to about 20% by weight of said liquid detergent composition of an organic solvent;

wherein said liquid matrix has a yield stress of from about 0.003 Pa to about 5.0 Pa at about 25° C. and wherein said surfactant system has a ratio of about 2.5:1 to about 18:1 of anionic surfactant to said amine oxide.

2. The liquid detergent composition of claim 1, wherein the liquid matrix comprises from about 0.006% to about 0.2% of bacterial cellulose by weight of said liquid detergent composition, wherein the liquid matrix has a yield stress from about 0.005 Pa to about 1 Pa.

3. The liquid detergent composition of claim 1, wherein said liquid matrix is a shear thinning fluid having a ratio of low stress viscosity to pouring viscosity of from about 2 to about 2000.

4. The liquid detergent composition of claim 1, wherein said external structuring system further comprises a carboxymethylcellulose, a modified carboxymethylcellulose, and mixtures thereof; and optionally, a polymeric thickener selected from xanthum products, pectin, alginates, gellan gum, welan gum, diutan gum, rhamsan gum, carrageenan, guar gum, agar, gum arabic, gum ghatti, karaya gum, gum tragacanth, tamarind gum, locust bean gum, and mixtures thereof.

5. The liquid detergent composition of claim 1, wherein said bacterial cellulose network comprises a widest cross sectional microfiber width of from about 1.6 nm to about 200 nm, and wherein said bacterial cellulose network further comprised a microfiber aspect ratio of about 10:1 to about 1000:1.

6. The liquid detergent composition of claim 1, further comprising b. from about 0.01% to about 5% by weight of said liquid detergent composition of a plurality of suspension particles.

7. The liquid detergent composition of claim 6, wherein said plurality of suspension particles comprises a particle size from about 100 nanometers to about 8 mm.

8. The liquid detergent composition of claim 6, wherein said plurality of suspension particles comprises an average particle density of from about 700 kg/m$^3$ to about 4,260 kg/m$^3$ at about 25° C.

9. The liquid detergent composition of claim 6, further comprising a plurality of suspension particles to liquid matrix density difference of from 1 kg/m$^3$ to 3,260 kg/m$^3$ at about 25° C.

10. The liquid detergent composition of claim 1, wherein said liquid matrix has a pH from about 6 to about 13.

11. The liquid detergent composition of claim 1, wherein said liquid matrix has a turbidity of 20 to 320 Nephelometric Turbidity Units.

12. The liquid detergent composition of claim 1, wherein said anionic surfactant comprises a C8-C18 linear alkyl benzene sulfonate surfactant, an alkyl ether sulfate surfactant, or a combination thereof.

13. The composition of claim 1, further comprising an SMNI Index as defined herein of at least about 0.099.

14. The composition of claim 1, wherein said bacterial cellulose network comprises at least one of a CV400 and a CV630, as defined herein, of from about 10% to about 39%.

15. The composition of claim 1, wherein said bacterial cellulose network, when viewed under 400x darkfield imaging, comprises a greatest straight line distance between two points of the skeletonized bacterial fiber network of less than about 250 microns.

* * * * *